US009267260B2

(12) United States Patent
MacDonald et al.

(10) Patent No.: US 9,267,260 B2
(45) **Date of Patent: *Feb. 23, 2016**

(54) SLANT WALL BLOCK AND WALL SECTION INCLUDING SAME

(71) Applicant: Keystone Retaining Wall Systems LLC, Minneapolis, MN (US)

(72) Inventors: Robert A. MacDonald, Plymouth, MN (US); Thomas S. Riccobene, Albuquerque, NM (US)

(73) Assignee: Keystone Retaining Wall Systems LLC, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/524,404

(22) Filed: Oct. 27, 2014

(65) Prior Publication Data

US 2015/0040507 A1 Feb. 12, 2015

Related U.S. Application Data

(63) Continuation of application No. 13/622,721, filed on Sep. 19, 2012, now Pat. No. 8,887,469.

(60) Provisional application No. 61/536,904, filed on Sep. 20, 2011.

(51) Int. Cl.
*E04B 5/04* (2006.01)
*E02D 29/02* (2006.01)
(Continued)

(52) U.S. Cl.
CPC ..... *E02D 29/025* (2013.01); *E04B 1/04* (2013.01); *E04B 2/46* (2013.01); *E04C 1/395* (2013.01);
(Continued)

(58) Field of Classification Search
CPC ..... E04C 1/395; E04C 1/41; E02D 29/025; E04B 2002/0263; E04B 2002/0208; E04B 2/46; E04B 1/04; E04B 2002/0243; E04B 2002/0256; E04B 2002/0215
USPC ..... 52/585.1, 592.5, 604, 605, 608
See application file for complete search history.

(56) References Cited

U.S. PATENT DOCUMENTS 730,150 A 6/1903 Pfahl
1,464,423 A 8/1923 Hardoncourt
(Continued)

FOREIGN PATENT DOCUMENTS

TW 136236 8/2010
TW 136239 8/2010
TW 136420 8/2011

OTHER PUBLICATIONS

"Imagine the Possibilities" 2007 Keystone Retaining Wall Systems Inc. brochure.

(Continued)

*Primary Examiner* — Brian Glessner
*Assistant Examiner* — Joshua Ihezie
(74) *Attorney, Agent, or Firm* — Greer, Burns & Crain, Ltd.

(57) ABSTRACT

A wall block comprises an upper surface and an opposed lower surface. A front face and an opposed back face, and a first side face and an opposed second side face, are disposed between the upper surface and the lower surface. The first side face and the second side face generally extend from the front face to the back face. The block includes one or more features that define a horizontal alignment direction. The front face extends from the first side face to the second side face generally along a direction that is slanted with respect to the horizontal alignment direction.

22 Claims, 24 Drawing Sheets

(51) Int. Cl.

| | |
|---|---|
| ***E04C 1/39*** | (2006.01) |
| ***E04B 1/04*** | (2006.01) |
| ***E04B 2/46*** | (2006.01) |
| ***E04C 1/41*** | (2006.01) |
| *E04B 2/02* | (2006.01) |

(52) U.S. Cl.

CPC ..... *E04C 1/41* (2013.01); *E04B 2002/0215* (2013.01); *E04B 2002/0243* (2013.01); *E04B 2002/0256* (2013.01)

(56) References Cited

U.S. PATENT DOCUMENTS

| | | | | |
|---|---|---|---|---|
| 1,773,686 | A | 9/1928 | Linde | |
| 2,271,728 | A | 9/1940 | Bainbridge | |
| 3,394,521 | A | 7/1968 | Coleman | |
| 3,906,665 | A | 9/1975 | Medlin | |
| D297,767 | S | 9/1988 | Forsberg | |
| 4,920,712 | A * | 5/1990 | Dean, Jr. | 405/286 |
| D321,060 | S * | 10/1991 | Blomquist et al. | D25/118 |
| 5,214,898 | A * | 6/1993 | Beretta | 52/606 |
| 5,466,089 | A * | 11/1995 | Jurik | 404/34 |
| 5,535,563 | A | 7/1996 | Brown et al. | |
| 5,700,983 | A * | 12/1997 | VonDross | 181/285 |
| 5,732,518 | A | 3/1998 | Roberts | |
| 5,765,970 | A | 6/1998 | Fox | |
| 5,951,210 | A | 9/1999 | Maguire et al. | |
| 6,019,550 | A * | 2/2000 | Wrigley et al. | 405/262 |
| 6,035,599 | A * | 3/2000 | Sonnentag | 52/604 |
| 6,076,318 | A * | 6/2000 | Grimm et al. | 52/245 |
| D429,531 | S * | 8/2000 | VonDross | D25/114 |
| D447,573 | S | 9/2001 | Blomquist et al. | |
| 6,398,458 | B1 * | 6/2002 | Pacitto et al. | 405/286 |
| 6,447,213 | B1 | 9/2002 | MacDonald | |
| D467,009 | S | 12/2002 | Agee | |
| 6,615,561 | B2 | 9/2003 | MacDonald et al. | |
| 6,701,687 | B1 | 3/2004 | Shillingburg | |
| 6,705,797 | B1 * | 3/2004 | Wada | 404/38 |
| 6,715,965 | B2 | 4/2004 | Manthei et al. | |
| 6,854,702 | B2 | 2/2005 | Manthei et al. | |
| 6,874,293 | B2 | 4/2005 | Manthei | |
| 6,912,823 | B2 * | 7/2005 | MacDonald et al. | 52/574 |
| 7,011,474 | B2 * | 3/2006 | MacDonald | 405/284 |
| 7,048,472 | B2 * | 5/2006 | Woolford et al. | 405/286 |
| 7,328,537 | B2 * | 2/2008 | Hammer | 52/604 |
| 7,448,830 | B2 * | 11/2008 | MacDonald et al. | 405/284 |
| 7,743,574 | B2 | 6/2010 | Tufts et al. | |
| D624,666 | S | 9/2010 | LaCroix et al. | |
| 7,849,656 | B2 | 12/2010 | Mugge et al. | |
| D633,629 | S | 3/2011 | MacDonald et al. | |
| 7,918,628 | B1 | 4/2011 | Siver et al. | |
| D647,218 | S * | 10/2011 | MacDonald | D25/113 |
| D647,219 | S * | 10/2011 | MacDonald | D25/113 |
| D665,514 | S | 8/2012 | MacDonald | |
| D665,515 | S | 8/2012 | MacDonald | |
| 8,887,469 | B2 * | 11/2014 | MacDonald et al. | 52/608 |
| 2002/0001509 | A1 * | 1/2002 | Hong | 405/286 |
| 2003/0041546 | A1 | 3/2003 | Bott et al. | |
| 2003/0074856 | A1 * | 4/2003 | Hammer | 52/604 |
| 2005/0102949 | A1 * | 5/2005 | Whitson | 52/596 |
| 2006/0117697 | A1 * | 6/2006 | Adam | 52/596 |
| 2007/0234665 | A1 | 10/2007 | Price | |
| 2008/0159815 | A1 | 7/2008 | Manthei et al. | |
| 2008/0277561 | A1 * | 11/2008 | MacDonald | 249/158 |
| 2010/0294169 | A1 * | 11/2010 | Clark et al. | 106/707 |
| 2011/0217127 | A1 * | 9/2011 | MacDonald | 405/284 |
| 2011/0243669 | A1 * | 10/2011 | Friederichs et al. | 405/284 |
| 2013/0034392 | A1 * | 2/2013 | Ferraiolo | 405/284 |

OTHER PUBLICATIONS

Search Report from International Application No. PCT/US 12/56071; Dec. 17, 2012.

Taiwanese Office Action for Application No. 102303983 dated Dec. 6, 2012.

"Retaining Walls You Can Install Yourself!", 2002 Pavestone Concrete brochure.

* cited by examiner

SLANT WALL BLOCK AND WALL SECTION INCLUDING SAME

PRIORITY CLAIM

This application is a continuation of U.S. patent application Ser. No. 13/622,721, filed Sep. 19, 2012, which claims priority to U.S. Provisional Patent Application No. 61/536,904, filed Sep. 20, 2011. U.S. patent application Ser. No. 13/622,721 is incorporated in its entirety by reference herein.

FIELD OF THE INVENTION

The subject disclosure relates to wall systems and blocks for same, and in particular to block wall systems.

BACKGROUND

It is well known to construct walls and other structures with blocks, which can be made from concrete, brick, or various other materials. Blocks are conventionally provided in geometric shapes, and are typically are laid in repeating patterns. Walls can be constructed vertically or set back, i.e., where each successive course is set back relative to lower courses, which is desirable in constructing retaining walls. It is desirable to construct walls, such as retaining walls, and other structures that have a unique appearance and are aesthetically pleasing. However, it is useful for such structures to be able to be constructed easily and consistently from manufactured blocks.

SUMMARY

Slant wall blocks and wall systems, e.g., partial or full wall systems including wall blocks, are provided. A first exemplary wall block embodiment comprises an upper surface and a lower surface, where the lower surface is opposed to the upper surface. A front face and an opposed back face are disposed between the upper surface and the lower surface. The block includes one or more features that define a horizontal alignment direction. A first side face and an opposed second side face are disposed between the upper surface and the lower surface. Both the first side face and the second side face generally extend from the front face to the back face. The front face extends from the first side face to the second side face generally along a direction that is slanted with respect to the horizontal alignment direction.

As used herein, "general extension," "generally extends," or analogous language refers to an overall trajectory of a particular block face along a straight path between its opposing ends. These ends are typically defined at edges (which can be, but need not be, hard edges) where adjacent faces meet. It is contemplated that the faces can have surface features, extensions, recesses, mating edges, etc. that are not part of the overall path or extension of the face, and various examples of such features are described and shown herein. Such features can cause the particular face to be extended beyond or set back from the general extension of the face.

The terms "along a line," "perpendicular," and "parallel" should be understood not to necessarily be perfect lines or orientations given manufacturing tolerances, e.g., though it is preferred that such lines approximate such lines or orientations as closely as possible. "Slanted" refers to following a line that is in an oblique direction with respect to another line. "Opposed" faces or surfaces need not be perfectly opposed for particular blocks, but can be generally on opposite sides of the block. Similarly, "disposed between" need not require that every point of a particular face be completely located between particular faces or surfaces. "Essentially" (e.g., "essentially smooth" or "essentially rough") refers to an overall state. The term "between" can be considered inclusive or exclusive. "Downwardly" refers to a direction from the top surface towards the bottom surface. "First side" and "second side" are used for clarity of description, and are not intended to require a particular order. For instance, "first side" can refer to a left side and "second side" to a right side, or vice versa.

A wall section embodiment, also referred to herein as a partial wall system, and a method for constructing a wall section are also provided. It will be appreciated that a wall section or partial wall system can stand alone or be a part of a larger wall, and that a method for constructing a wall section can be part of a method for constructing a complete wall.

A wall section can include a plurality of courses. An example course includes a plurality of blocks arranged side to side in a line to form at least one course. Each block comprises an upper surface and a lower surface, where the lower surface is opposed to the upper surface, a front face and an opposed back face disposed between the upper surface and the lower surface, and a first side face and an opposed second side face disposed between the upper surface and the lower surface. The front faces of the blocks are slanted relative to the line, to form a generally jagged or sawtoothed shape.

In some example embodiments, each block comprises a projection disposed at the front face adjacent the first side, a mating surface disposed adjacent the projection, and a mating edge at the intersection of the front face and the second side. The blocks are arranged such that the mating edge of each successive block in the course is placed to match, e.g., be captured or engaged with, the mating surface of an adjacent block.

It is not required that every block in a particular course, or every block among courses, have the same configuration or orientation. In certain example embodiments, the configuration and/or orientation can vary, and in other example embodiments, the configuration and/or orientation can be the same.

In some example embodiments, the blocks are arranged to further provide at least a second course on top of the first course. Blocks in the second course are preferably staggered from left to right with respect to the blocks in the first course. Examples of staggered arrangement include, but are not limited to, running bond, half bond, quarter bond, three-quarter bond, etc. Other, non-staggered arrangements are possible, including stack bond arrangements.

The blocks in the second course can be in a line, or in more than one line, parallel to the line of the first course. The second course may include blocks having a different configuration and/or orientations as the blocks in the first course, for instance so that the front faces of the blocks in the second course are slanted in a direction opposite to the slant of the front faces of the blocks in the first course. "First" and "second" are used for identification purposes, and are not intended to imply a particular order. In one example wall embodiment, the courses are substantially vertically aligned such that the wall is substantially vertical. In another example embodiment, the second course is set back from the first by a predetermined distance, which is preferred for retaining wall applications. Other embodiments are discussed below in reference to the drawings. Still other embodiments will be apparent to those skilled in the art.

DETAILED DESCRIPTION

Figure 1A:
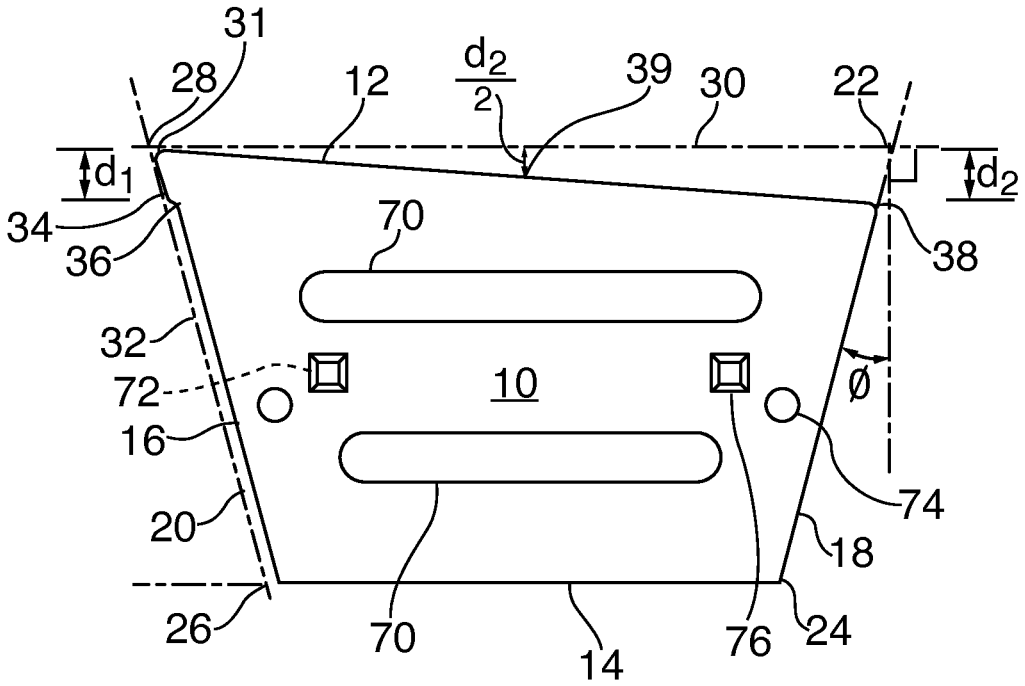
FIG. 1*a* is a top plan view of a first embodiment of a slant wall block.

Various embodiments of the invention are described below by way of example only, with reference to the accompanying drawings. The drawings include schematic figures that may not be to scale, which will be fully understood by skilled artisans with reference to the accompanying description. Features may be exaggerated for purposes of illustration. From the preferred embodiments, artisans will recognize additional features and broader aspects of the invention.

Turning now to the drawings, a first embodiment of a slant block 10 is shown in FIGS. 1*a*-1*d*. Block 10 includes a front face 12, a back face 14, a first side face 16 and a second side face 18. Block 10 is derived from a theoretical trapezoid 20, formed between points 22, 24, 26 and 28. Lower right point 24 in the example slant block 10 (directions for the theoretical trapezoid 20 are for the orientation shown in FIG. 1*a*) is taken from an edge where the back face 14 meets the second side face 18. Note that "edge" need not refer to a well defined edge in every embodiment, but instead may generally refer to a location where two adjacent faces meet, such as where the back face 14 meets the second side face 18. The lower base of the theoretical trapezoid 20 is formed from a line following the general extension of the back face 14.

A theoretical construction line 30 is shown in FIG. 1, which represents the front edge of a course of blocks. The forward point 31 of block 10 meets the construction line 30. "Meets" can refer to touching or nearly touching the line. The construction line maybe a straight line, or in a substantially smooth convex or concave curved line, or in a circle, or combinations thereof, depending on the structure to be constructed. This construction line 30 extends along a horizontal alignment direction. As used herein, the term "horizontal alignment direction" refers to a reference direction by which adjacent blocks are positioned and aligned in a line, such as a construction line. The block 10 can include one or more features that define the horizontal alignment direction. As explained in greater detail below in reference to example embodiments, such features can include projections, noses, notches, recesses, cores, lips, indicia, etc., or combinations thereof formed in or on the block that is/are configured for aligning each successive block in a course such the front face of each block is offset relative to adjacent blocks and so that the front faces of blocks in the course are substantially uniformly slanted (i.e., slanted along substantially the same angle or rotated by substantially the same angle in either clockwise or counterclockwise directions) relative to the construction line. Particular representative examples are shown and described herein.

Front face 12 is preferably longer than back face 14. Further, as can be seen in FIGS. 1*a*-1*d*, front face 12 extends from the first side face 16 to the second side face 18 generally along a direction that is slanted with respect to the horizontal alignment direction. In the example block 10, this also slants front face 12 with respect to back face 14, and makes the general extension of left side 16 longer than that of right side 18, though this is not required in all embodiments. In FIG. 1, the front face 12 is rotationally spaced away from the construction line 30 in a clockwise direction about point 28. In other embodiments (not shown), the front face 12 is substantially the same length as back face 14, and both faces are slanted, e.g., to form a parallelogram.

In an example embodiment, side faces 16 and 18 are generally set at a side angle ϕ (measured from a line perpendicular to horizontal construction line 30) that is preferably, but not necessarily, equally divisible into 360 degrees, such as between 5 and 20 degrees, and more preferably 10 to 15 degrees. This allows the side faces 16 and 18 to extend from the front face 12 to the back face 14 generally along directions that form acute angles (as shown in FIG. 1*a*) with respect to the front face (and obtuse angles with respect to the general extension of the back face). By going to a lesser side angle ϕ, the units fit tighter side-by-side, but the larger side angles permit greater range of curvature (convex and concave). A line along the general extension of side face 18 at angle ϕ, from the back face 14 to where this line meets the construction line 30 (at point 22) provides the right leg of the theoretical trapezoid 20. Theoretical left leg 32 in this example embodiment is also set at angle ϕ, and intersects the left point 28 of the block. Theoretic left leg 32 extends from the construction line 30, at point 28, to the lower base of the theoretical trapezoid 20, at point 26. In the theoretical trapezoid 20, the base angles at points 28 and 22 are acute, and the base angles at points 24 and 26 are obtuse. However, it is not required that the first and second sides 16, 18 both be angled as shown in FIGS. 1*a*-1*d*. In other embodiments, one side (either first side 16 or second 18) generally extends along an angle, such as but not limited to at angle ϕ, and the other side generally extends along the same angle, a different angle, or even orthogonally with respect to the horizontal alignment direction. In still other embodiments, both the first side 16 and the second side 18 are orthogonal with respect to the horizontal alignment direction.

As shown in FIG. 1, side face 16 is preferably setback from theoretical line 32 between points 26 and 28. A projection, such as nose 34, is formed at the front face adjacent left side 16. The nose 34 may be pointed as shown, rounded, square or any other shape. A mating surface such as but not limited to a notch 36 is formed adjacent the nose 34 and is configured to receive a mating edge, such but not limited to the corner 38, of an adjacent block. Generally, the "mating surface" and the "mating edge" are any surfaces that are configured to mate, and it is preferred though not required that the mating surface be configured to receive at least a portion of the mating edge.

The depth (d1) of nose 34 (that is, between the front point 31 and mating surface (notch) 36) preferably approximates the delta slant (d2) of front face 12. "Approximates" includes the possibility that depth d1 can be slightly smaller than delta slant d2 to allow for freedom of movement. The delta slant is defined as the front to back distance between the left and right ends of the general extension of the front face 12, and in the example block 10 is also the distance between the construction line 30 and a rearward point of the front face; that is, at mating edge (corner) 38. If (d1) approximates (d2), the configuration of the mating surface and the mating edge can define the horizontal alignment direction. For example, as shown in FIG. 1*a*, the horizontal alignment direction can be defined by a straight line connecting corner 38 and notch 36. Again, "general extension" is used because it is contemplated that the front face 12 could have additional frontward extending surface features that are not part of the overall slant of the front face. In an example embodiment, the front face 12 is slanted such that a center point 39 of the front face is set back by a distance that is half of the overall delta slant (d2). In other example embodiments, the nose 34 is omitted and a marker, such as but not limited to a groove, replaces notch 36. In such embodiments, the horizontal alignment direction can be defined by a line extending between the groove and the mating edge (corner) 38.

In preferred embodiments, the front face 12 has a width of between about 12-18 inches and a (d2) dimension in the range of about ½ to 2 inches. However smaller or larger units with less or more slants/offsets are possible. In one preferred embodiment, the block is 12 inches wide, by 4 inches high, with a (d2) dimension of 1 inch.

Figure 2A:
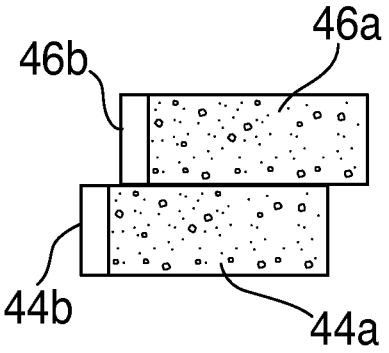
FIG. 2*a* is a side elevation view of two stacked blocks, where the upper block is set back with respect to the lower block.

Block 10 has a top face 40 and a generally parallel bottom face 42 in order to be stackable, as shown for example in FIG. 2*a*. The faces 40 and 42 need not be flat as shown and further may comprise cores, holes, cavities, slots, mating tongue/groove patterns, etc., as shown for example in U.S. Pat. Nos. 6,615,561, 6,447,213, 6,854,231, and 7,168,892, which are hereby incorporated by reference. Such holes, cavities, slots, or mating tongue/groove patterns can, alone or in combination, be used to define the horizontal alignment direction.

Front, back and side faces 12, 14, 16 and 18 are preferably substantially perpendicular to the top and bottom faces 40, 42; however, they need not be perpendicular. Further, the front and side faces 12, 14, 16, 18 need not be flat as shown and may be irregularly shaped, including but not limited to curved shapes. Also, the sides optionally may be provided with mating tongue/groove patterns running in either a vertical or horizontal direction. The front face 12 may be desirably molded, curved, split, vertical slanted fin, stair stepped, laminated, printed or otherwise modified for enhanced aesthetic effect. FIG. 1*e* shows an example slant block 10*a* having a vertical slanted fin front face 12. FIG. 1*f* shows another example slant block 10*b* in which the side faces 16, 18 are configured as complementary curves. Those of ordinary skill in the art will appreciate that many combinations of configurations for the faces 12, 14, 16, 18 and for the top and bottom surfaces 40, 42 are possible.

Various embodiments of the blocks are possible. For example, the first side face 16 of the block 10 can be pulled inwardly from the theoretical line 32 by a smaller or greater distance. Alternatively, notch 36 can be rounded, or have any other shape, though it is preferred that the notch be configured to receive a corner 38. Other example blocks omit a nose or notch, such that first side face 16 is even with theoretical line 32. In other embodiments, side faces 16, 18 can be curved, e.g., having complementary curves. The back face 14 can also vary in configuration, including extending along a direction that is parallel to or slanted with respect to the horizontal alignment direction.

Figure 2B:
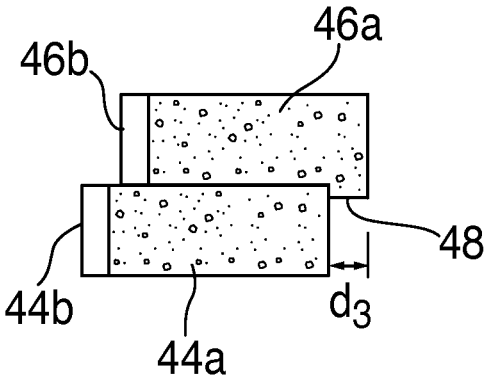
FIG. 2*b* is a side elevation view of two alternative embodiment stacked blocks, showing an optional lip embodiment.
Figure 2C:
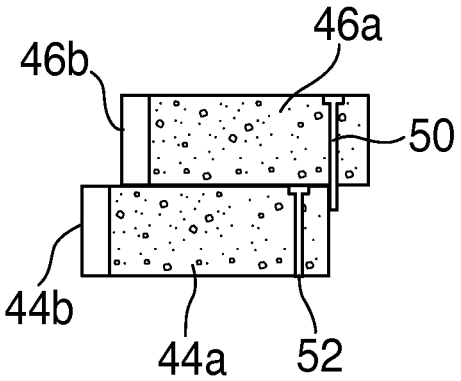
FIG. 2*c* is a partial sectional view of two alternative embodiment stacked blocks, showing an optional pin embodiment.

FIGS. 2*a*-2*c* show embodiments of stacked blocks including a lower block 44*a* and an upper block 46*a*. Blocks 44*b* and 46*b* are horizontally adjacent blocks to blocks 44*a* and 46*a*, respectively. The blocks 44, 46 in FIG. 2*a* can be, for instance, similar to block 10. FIG. 2*b* illustrates an alternative embodiment comprising a lip 48 projecting downwardly from the bottom face 42 along the back face 14. Lip 48 may be continuous across the back face 14, or may comprise a plurality of spaced projections. In an example embodiment, a plurality of spaced projections is aligned along a direction that can be used to define the horizontal alignment direction.

The lip 48 is designed to facilitate construction of a retaining wall or other wall wherein blocks of each successive course are set back a predetermined distance relative to the underlying course, as shown in FIG. 2*b*. This arrangement of courses is referred to herein as a setback arrangement. In a preferred retaining wall embodiment, the depth of setback (d3) is approximately one-half of the delta depth of the slant (d2). This produces a desirable face alignment and aesthetic effect as described below in reference to FIGS. 3*a*-3*c* and 5, particularly when the front face 12 is slanted so that the center point 39 is also set back by one-half of the delta slant. In FIG. 2*b*, the depth of setback can be defined by a distance between the front point of the lip 48 and the back face 14 of the block 10. If the back faces 14 or the overall depth of the blocks 10 vary from block to block, the depth of setback can instead be defined by a distance between the front point of the lip 48 and the construction line 30 of the block 10, with a relatively smaller distance providing a relatively greater depth of setback.

A pin connector 50 inserted in a vertical core 52 can be used in lieu of a lip to define a predetermined setback distance, as shown in FIG. 2*c*. One or more pins may be adapted to be inserted in holes either at the back of the block as shown or in any other area of the block. The block may also include cores or slots/channels to receive connecting pins from adjacent courses, to assist in assembled block alignment, and to assist in reducing overall unit weight. Plural cores 52 or slots/channels can be aligned to define the horizontal alignment direction. However, it is not necessary for the block 10 to have cores, slots, or channels, and the horizontal alignment direction can be defined using other features, e.g., as shown and described herein. For instance, a solid block can be provided by omitting the cores, slots, and channels. In some example embodiments, the nose 34 and notch 36 can be omitted as well.

Figure 3A:
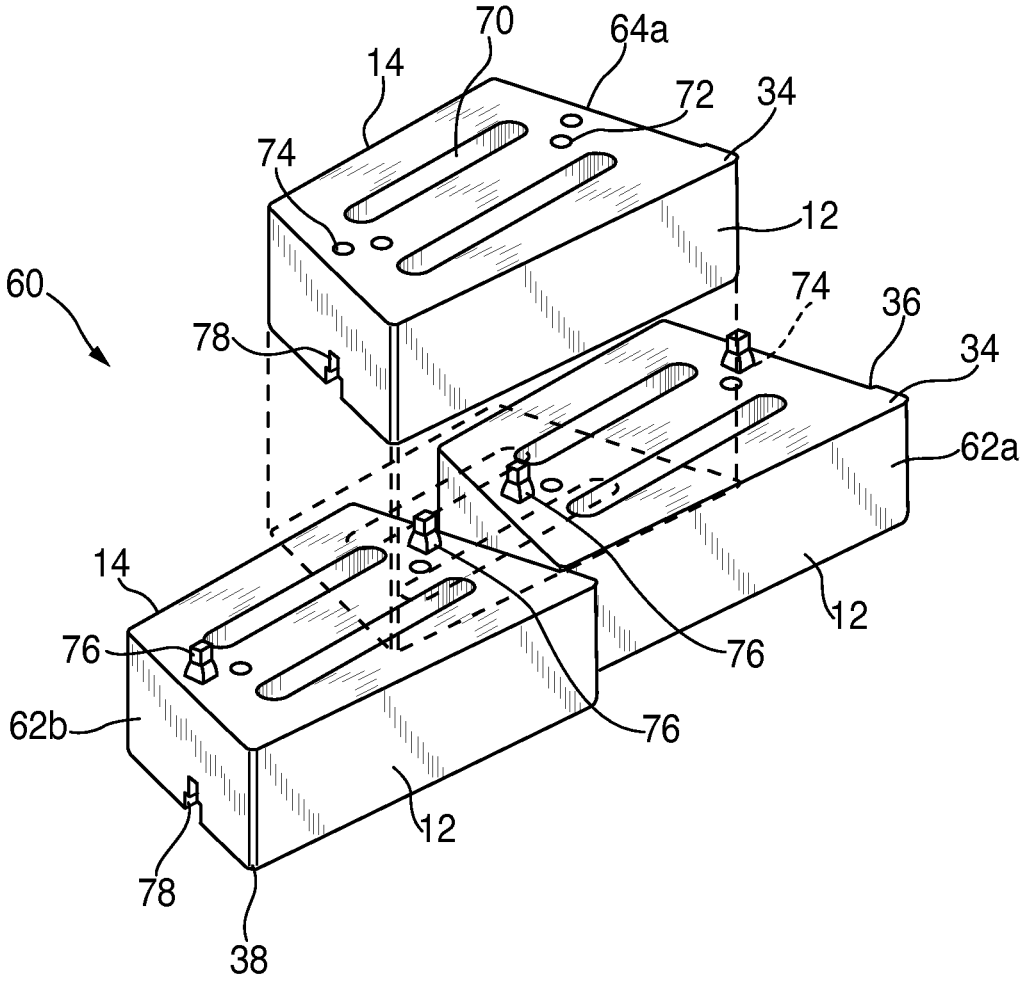
FIG. 3*a* is a perspective view of a first partial wall system comprised of three slant wall blocks of the FIG. 1 embodiment, in a setback arrangement.
Figure 3B:
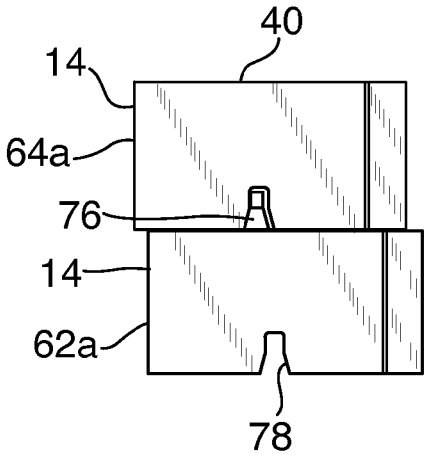
FIG. 3*b* is a side elevation view of the first partial wall system of FIG. 3*a*.
Figure 3C:
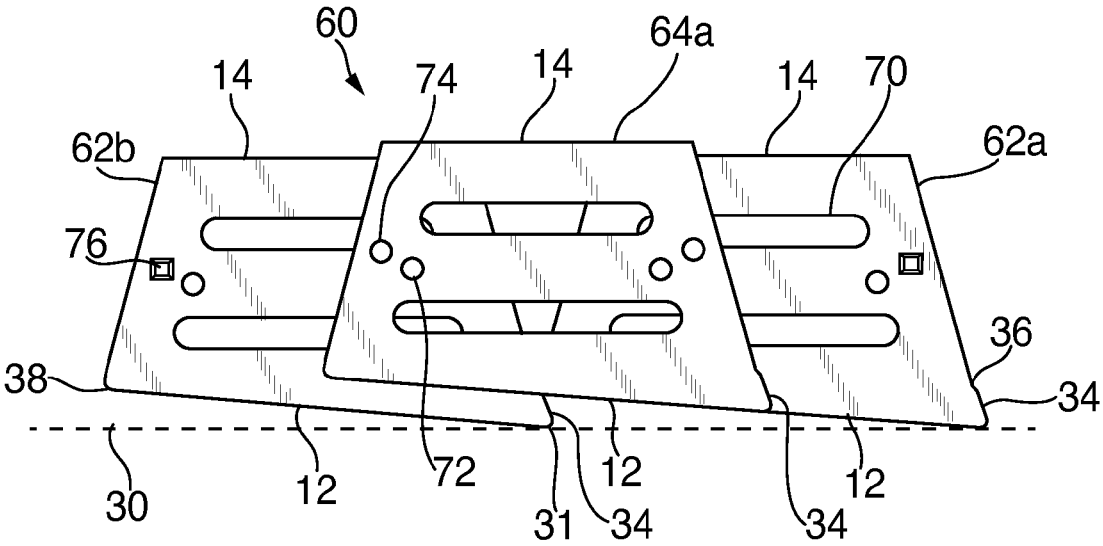
FIG. 3*c* is a top plan view of the first partial wall system of FIG. 3*a*.

FIGS. 3*a*-3*c* show a partial wall section 60 comprising a first course of blocks 62*a*, 62*b*, and a second course of blocks 64*a*, in a setback arrangement. Blocks 62 and 64 are substantially the same as block 10 shown in FIG. 1. The construction line 30, which aligns the front points of each of the blocks 62*a*, 62*b*, provides a theoretical front edge at the base of the wall. The front face of the resulting wall is jagged or saw tooth shaped relative to the horizontal alignment direction as shown in FIG. 3*c*. The second course 64 is set back from the lower course 62 as shown in FIGS. 3*a*-3*c*.

In an example method of constructing a course of blocks 10 a line is set for the front edge of the course, which can be a string line. The line is co-incident with the construction line 30. The first block 10 is laid and set relative to the construction line 30, with point 31 adjacent with the line and mating edge (corner) 38 being setback a distance d2 from the line. Each successive block is laid so that the mating edge 38 of each successive block in the course is matched to the notch 36 of the previously laid adjacent block. Then, the new block 10 is rotated about the mating edge 38 until the front point 31 of the block meets the line. Arranging successive blocks 10 in this way aligns all of them along the construction line 30. The back faces 14 of each block in the course 62 can be aligned in a line parallel to the construction line 30, though this is not required in all embodiments. Reinforcement such as geogrid soil reinforcement can be used to structure a wall, such as those described in U.S. Pat. No. 6,149,352.

Figure 4:
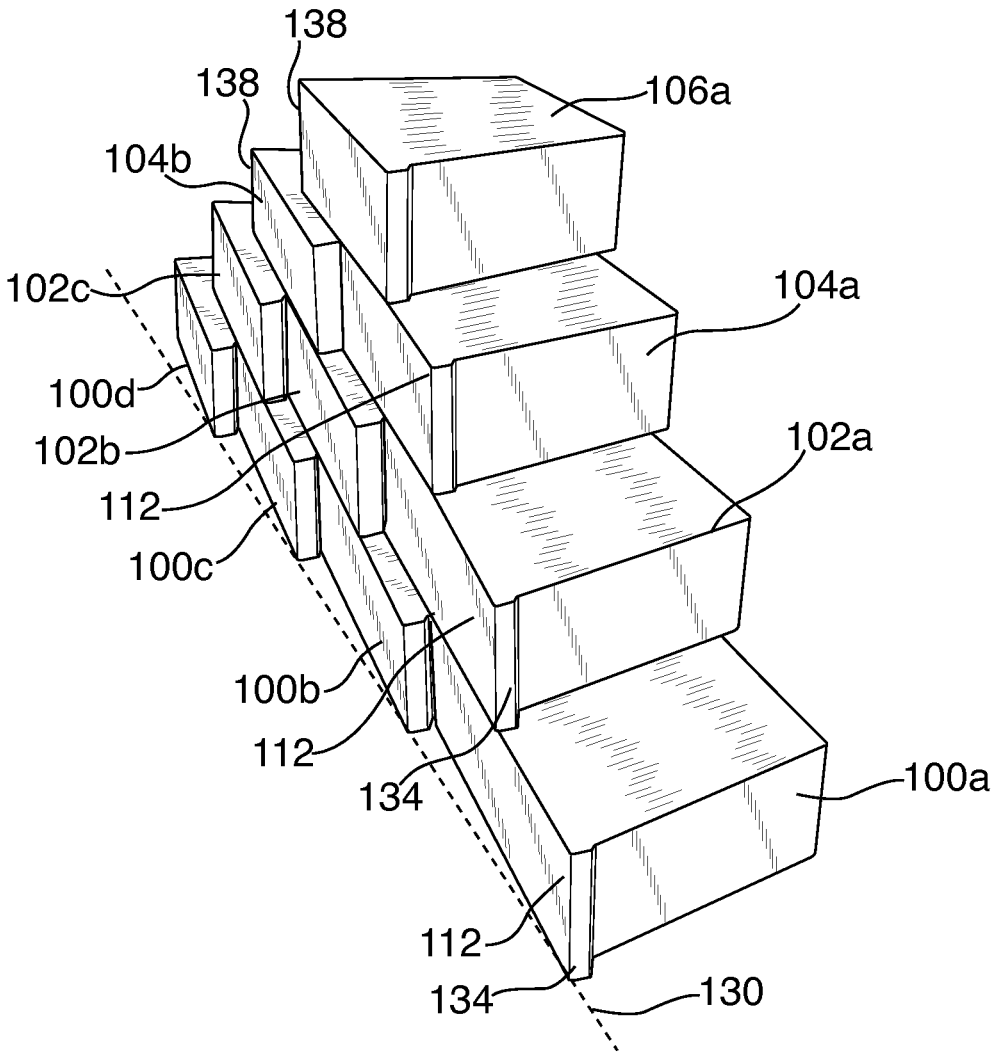
FIG. 4 is a side perspective view of a second partial wall system.

This arrangement is also shown in FIG. 4, which includes first course blocks 100*a*, 100*b*, 100*c*, 100*d*, second course blocks 102*a*, 102*b*, 102*c*, third course blocks 104*a*, 104*b*, and a fourth course block 106*a*. The blocks in courses 100, 102, 104, 106 can be similar to block 10. In FIG. 4, corner 138 of each successive block in a course is placed to be captured or connect with a notch 134 of an adjacent block.

Figure 21:
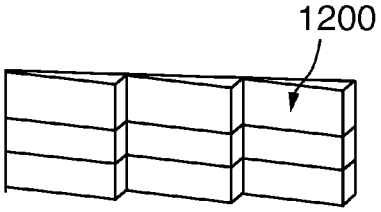
FIG. 21 is a perspective view of a sixteenth partial wall system including blocks in a stack bond arrangement.
Figure 22:
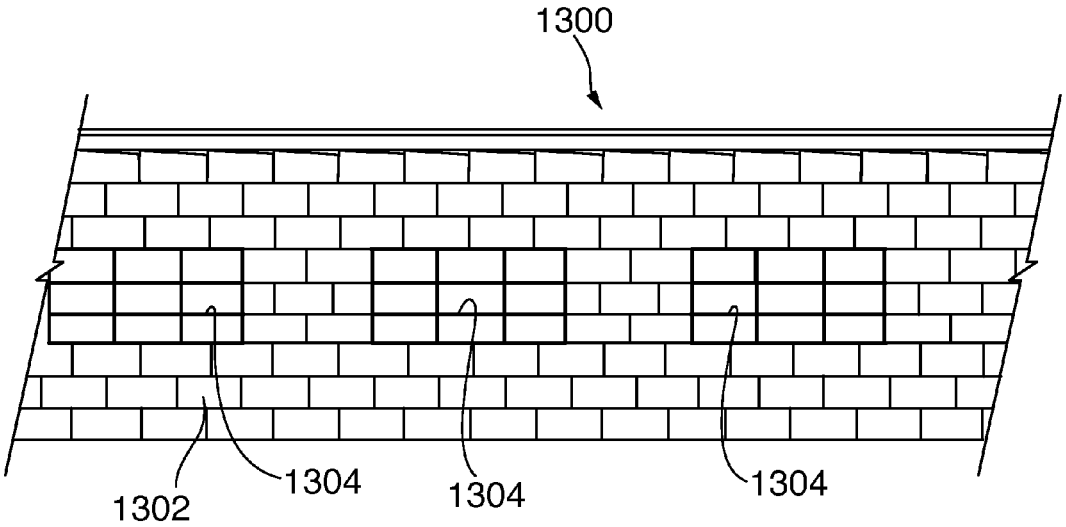
FIG. 22 is an elevation view of a seventeenth partial wall system including both running bond and stack bond arrangements.

The blocks of the next higher course are preferably placed in a staggered arrangement between (from left to right) adjacent blocks of the next lower course. Nonlimiting examples of staggered arrangements include running bond, half bond (e.g., as shown in FIGS. 3*a*, 3*c*, 4, 5*a*, and 5*c*), quarter bond, and three-quarter bond. Stack bond arrangements are also possible, such as shown in FIG. 21 below, in which the blocks sit directly (or nearly directly) over one another. A stack bond pattern can also be used as a panel for a wall generally made in a running bond pattern, as shown in FIG. 22 below. The stack bond pattern in this example provides an accent to the main wall.

Cap units (not shown) can be provided, and can overhang the front faces 12 or can line up flush with the innermost part of the example jagged or saw tooth design. Cap units can themselves be slanted or straight, and can be smooth or textured to match or complement the blocks 10. Nonlimiting example textures include raked, hard split, molded, corduroy, etc.

Referring again to FIG. 4, the blocks of the first course 100*a*, 100*b*, 100*c*, 100*d* are aligned with each other with respect to a line such as the horizontal alignment construction line 130. The blocks in the second course 102*a*, 102*b*, 102*c* are aligned with each other along a line that is parallel to the horizontal construction line 130, but set back from the horizontal construction line by a predetermined distance. Similarly, the blocks in the third course 104*a*, 104*b* are aligned with each other with respect to a line that is parallel to the construction line 130, but set back from the line of the second course blocks by a predetermined distance (which, for instance, can be the same as the predetermined setback distance for the second course), and so on. In other example arrangements, particular blocks in each course are aligned with different horizontal alignment directions.

In this example embodiment, given the depth of setback (d3) relative to the delta depth (d2) of the slant, the front face 112 of block 102*a* is substantially in the same plane as the front face of adjacent block 100*a* in the next lower course. Further, as shown in FIG. 4, the front face 112 of third course block 104*a* is substantially in the same vertical plane as the front face of block 102*a*, as is the front face of the fourth course block 106*a*. Likewise, the front faces 112 of blocks 104*b*, 102*b*, and 100*b* are substantially in the same vertical plane. Similarly, in FIG. 3*c*, the front face 12 of block 64*a* is substantially in the same vertical plane as the front face of block 62*a*. Continuing this pattern produces an aesthetically pleasing front surface as best viewed in FIG. 4. As shown in FIG. 4, the front faces 112 in successive courses are aligned, giving the wall the appearance of being in vertical alignment, when in fact the wall is a setback arrangement. This optical illusion gives this wall embodiment its unique character. The shape, slant, roughness, surface texture (e.g., rough texture, vertically raked texture, smooth texture, etc.) and/or color of the blocks, especially (but not exclusively) the front face 12, 112, may be varied across the face or from block-to-block to further enhance aesthetics.

Referring again to FIGS. 1*a*-1*d*, block 10 includes horizontally extending cores 70 that extend through the block between top face 40 and bottom face 42. Additionally, block 10 includes front and back pairs 72, 74 of pin cores extending though the block for selective insertion of connector pins (pins) 76 (e.g., FIG. 1*a*). The horizontally extending cores 70 and/or the pin cores 72, 74 can be either full depth or partial depth. A channel 78 is formed into bottom face 42 and preferably extending from side 16 to side 18 for receiving tops of pins 76. The channel 78 preferably has a suitable width to accommodate the width of the pin 76, and provides an alignment groove for the block 10. The block 10 may include other cores, e.g., for weight reduction or aesthetics. If the block is a completely solid unit, on the other hand, the cores can be omitted.

Both the front pair 72 and the back pair 74 of pin cores, with or without pins 76 inserted therein, are respectively aligned along a direction that is parallel to the construction line 30. See FIGS. 1*a*-1*b*. Further, the horizontal cores 70 and the channel 78 in the example block 10 extend along a direction parallel to the construction line 30. Each of these features accordingly can be used to define the horizontal alignment direction.

Figure 1B:
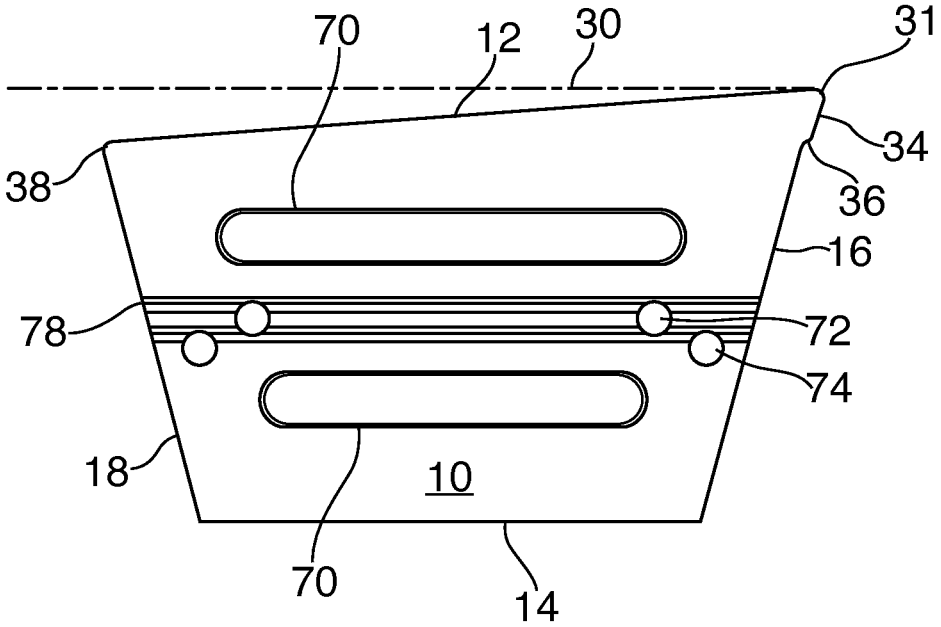
FIG. 1*b* is a bottom plan view of the slant wall block shown in FIG. 1*a*.
Figure 1C:
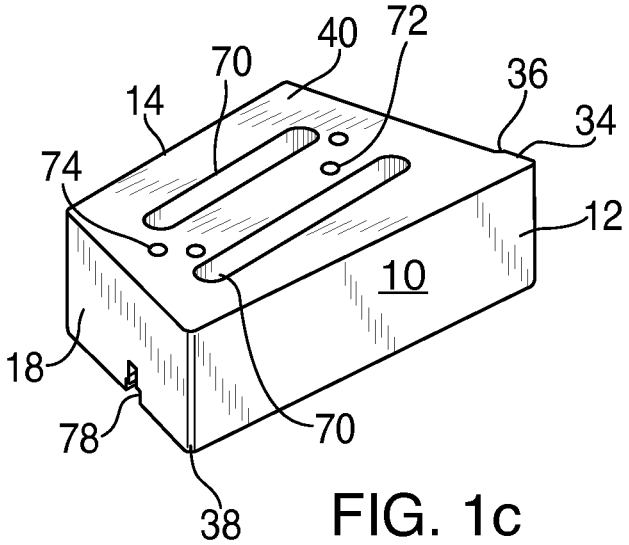
FIG. 1*c* is a top perspective view of the slant wall block shown in FIG. 1*a*.
Figure 1D:
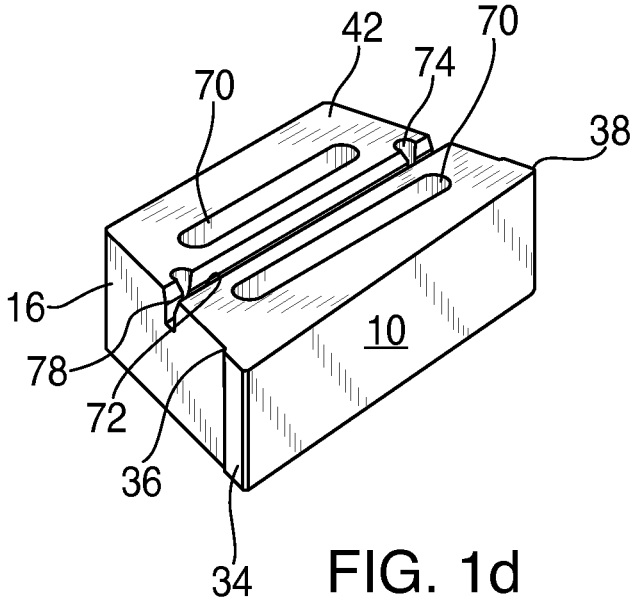
FIG. 1*d* is a bottom perspective view of the slant wall block shown in FIG. 1*a*.
Figure 1E:
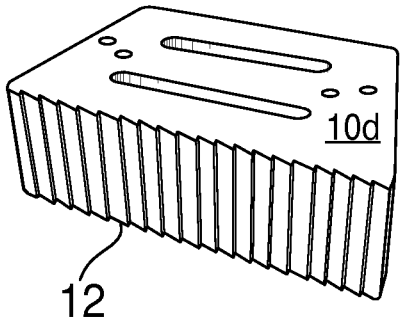
FIG. 1*e* is a perspective view of a second embodiment of a slant wall block having a vertical slanted fin surface.
Figure 1F:
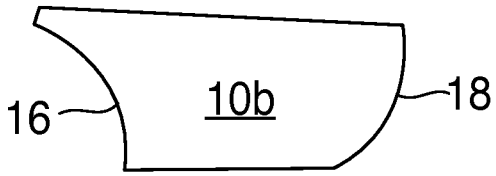
FIG. 1*f* is a plan view of a third embodiment of a slant wall block having complementary curved side faces.

As shown in FIG. 1*b*, the center of the channel 78 and the center of each of the front pair of pin cores 72 are equidistant from the construction line 30. The center of each of the back pair of pin cores 74 is set back from the centers of both the front pair of pin cores 72 and the channel 78, which defines a setback distance for stacked blocks 10. Inserting the pins 76 in either the front pair 72 or the back pair 74 of pin cores for a lower course of blocks 10 facilitates alignment of a next higher course of blocks in setback or vertical arrangement, respectively, as illustrated in FIGS. 3*a*-3*c* (setback) and FIGS. 5*a*-5*c* (vertical). The channel 78 and the pins 76 together guide the block 10 as it is placed over the pins of a next lower pair of adjacent blocks.

For example, in FIGS. 3*a*-3*c*, the pins 76 are placed into the rear pair of pin cores 74. The channel 78 of each block 64*a* in the second course sits over tops of the left and right pins 76, respectively, of adjacent blocks 62*a*, 62*b*, as best viewed in FIG. 3*a*, to provide the staggered left to right arrangement. The pins 76 align with the channel 78. Because the centers of the rear pair of pin cores 74 are set back from the center of the channel 78 by the predetermined setback distance, the construction line of the second course 64*a* is set back from the construction line 30 of the first course 62. The construction lines of each course are substantially parallel and thus are in the same plane, albeit the plane is angling back as is desired for retaining wall applications. In FIG. 3*c*, one can see that the front face 12 of block 64*a* in the second course is in same vertical plane as the front face of block 62*a* in the first course. This pattern repeats and provides an attractive aesthetic to the wall.

Figure 5A:
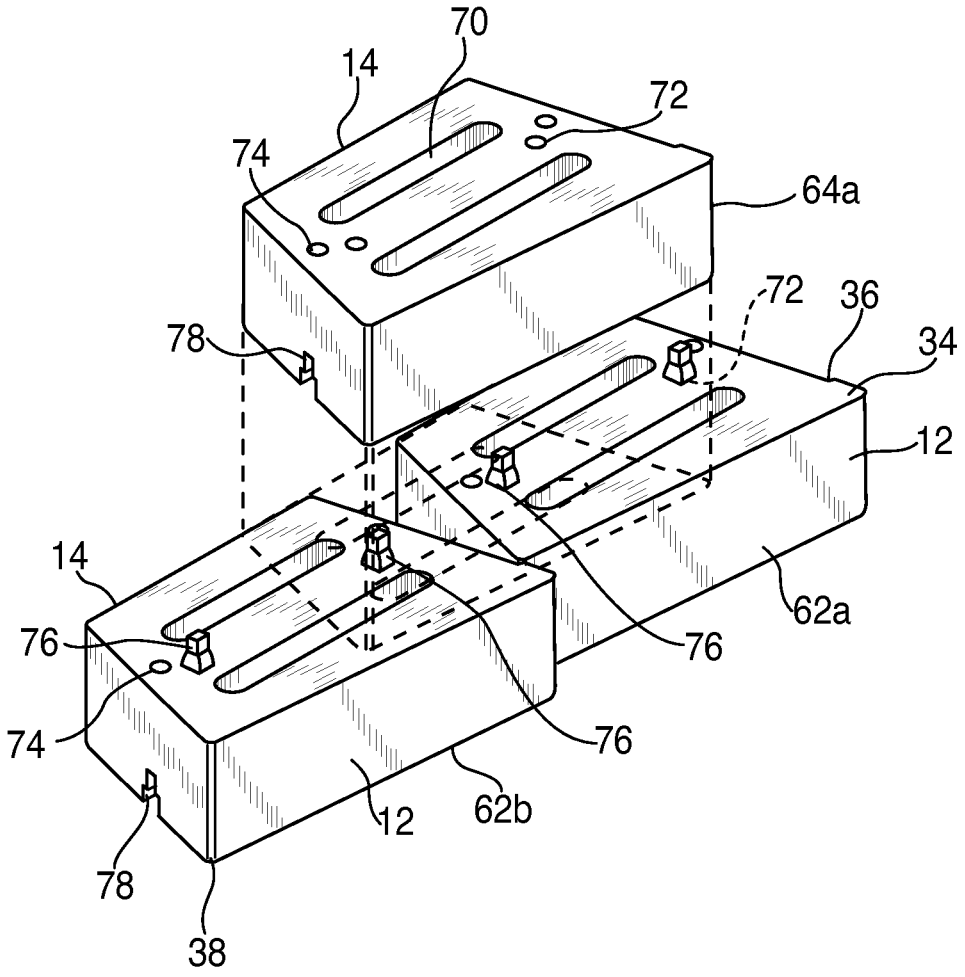
FIG. 5*a* is a perspective view of a third partial wall system comprised of three slant wall blocks of the FIG. 1 embodiment, in a vertical arrangement.
Figure 5B:
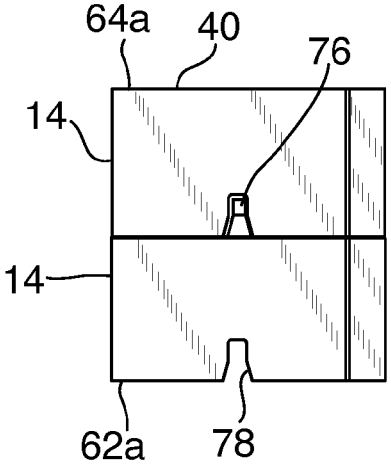
FIG. 5*b* is a side elevation view of the third partial wall system of FIG. 5*a*.
Figure 5C:
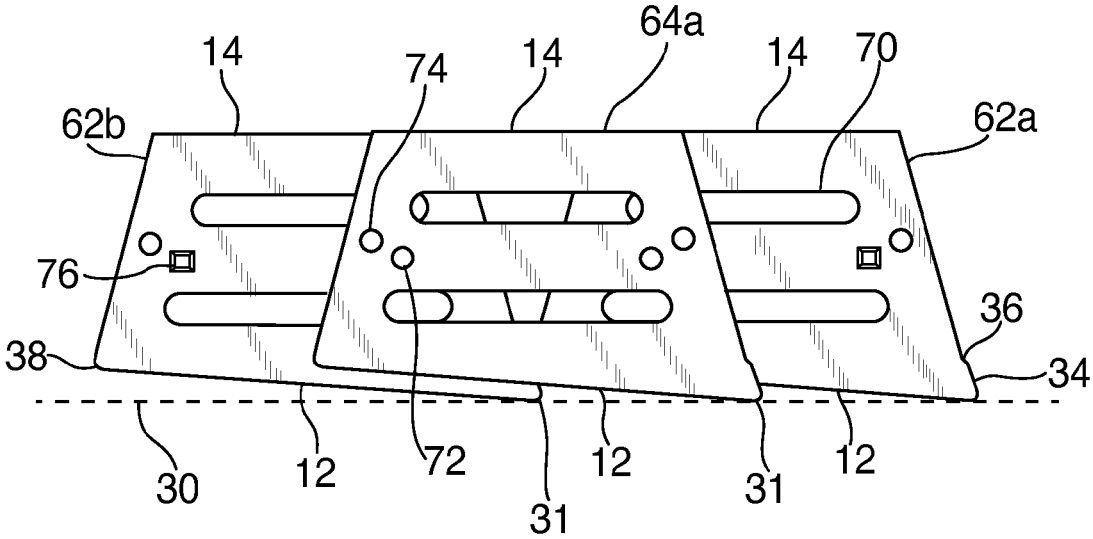
FIG. 5*c* is a top plan view of the third partial wall system of FIG. 5*a*.

By contrast, FIGS. 5*a*-5*c* show a vertical arrangement of blocks 90. As with the setback arrangement, the blocks 10 in each individual course 62, 64 can be laid so that the mating edge 38 of each successive block in a course is matched to the notch 36 of the adjacent block, and are aligned, e.g., with respect to the construction line 30. See FIG. 5*c*. Further, the block(s) 64*a* in the second course are placed in a staggered (in this example, half bond) arrangement between (from left to right) adjacent blocks 62*a*, 62*b* of the first course.

In the vertical arrangement, however, the second course 64 is arranged with respect to the first course 62 such that the construction lines 30 for both courses are substantially in the same vertical plane. "Vertical" as used herein refers to vertical or near-vertical; e.g. between 0° and 2° setback. For example, the pins 76 can be placed into the front pair of pin cores 72 for the blocks 62*a*, 62*b* in the first course 62 and the block 64*a* in the second course. Because the depth of the center of the channel 78 is aligned with the center of the front pair of pin cores 72, the second course block 62*a* has a construction line 30 that is in the same vertical plane as the construction lines 30 of the first course blocks 62*a*, 62*b*. See FIG. 5*b*. In FIGS. 5*a*-5*c*, back faces 14 of each block 10 in the first course 62 and the second course 64 are aligned substantially in the same plane, though this is not required in all embodiments.

As will be appreciated by persons skilled in the art, the vertical and setback arrangements of FIGS. 3-5 can be combined and varied. For example, one could alternate courses between vertical and setback arrangements to form a wall with an overall setback angle that is less than that of the FIGS. 3-5 embodiments.

Figure 6A:
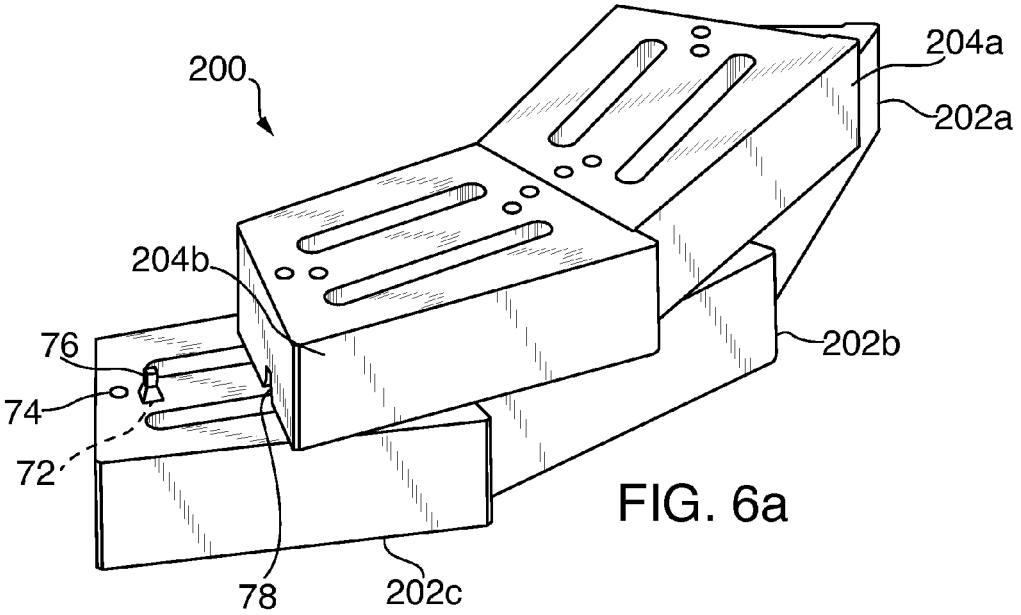
FIG. 6*a* is a perspective view of a fourth partial wall system showing a convex curve.
Figure 6B:
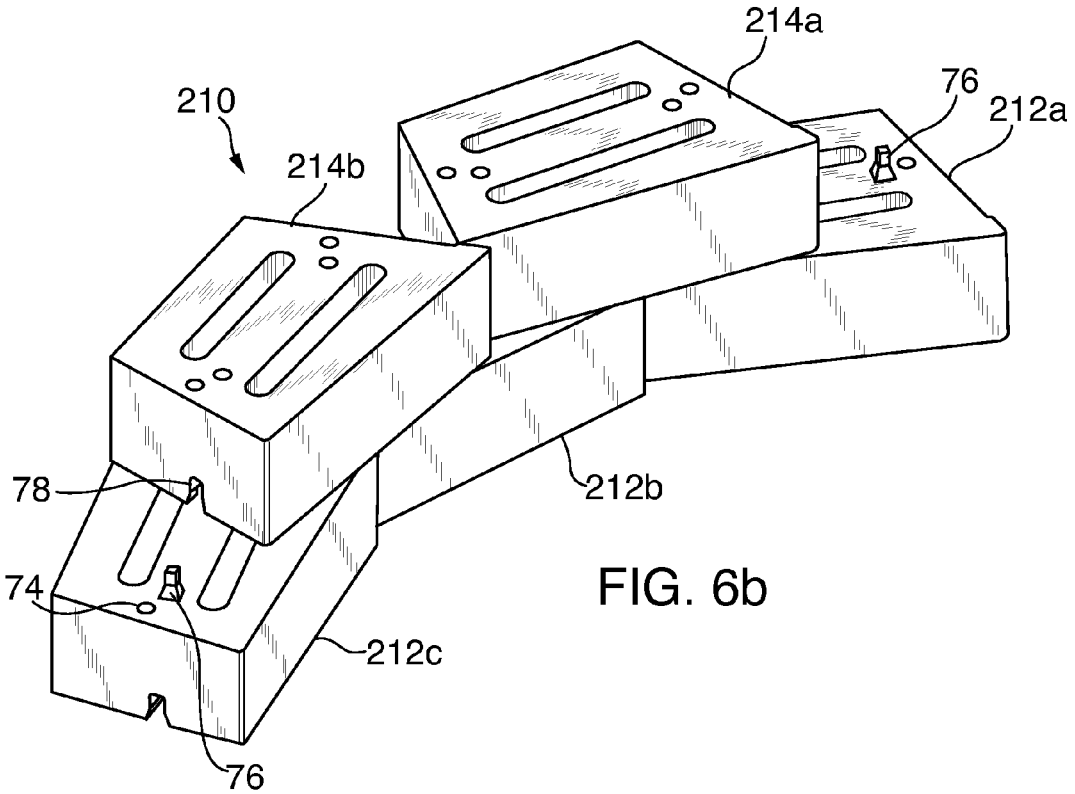
FIG. 6*b* is a perspective view of a fifth partial wall system showing a concave curve.
Figure 7:
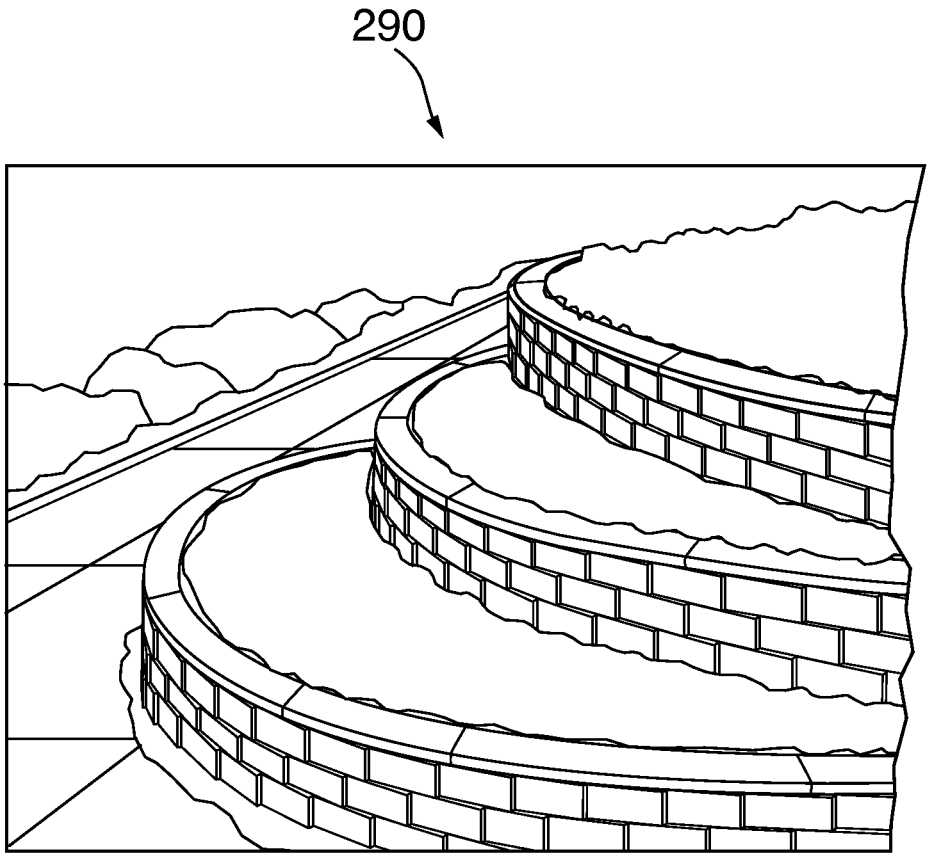
FIG. 7 is a perspective view of a multiple level retaining wall.

The example designs break up the standard rectilinear arrangement of most retaining walls, and add a somewhat contemporary geometric appearance to the wall. This is true for both straight and curved wall arrangements, as shown in FIGS. 6*a* and 6*b*. FIG. 6*a* shows a partial wall section 200 formed of courses 202, 204 having a convex curvature, and FIG. 6*b* shows a partial wall section 210 formed of courses 212, 214 with a concave curvature. In both FIGS. 6*a* and 6*b*, the horizontal alignment axes 30 of the first course 202, 212 and the second course 204, 214 provide line segments for the overall convex (FIG. 6*a*) and concave (FIG. 6*b*) curvature. In these example arrangements, pins 76 are inserted into the front pair of pin cores 72 for adjacent blocks in the first course 202, 212. The blocks in the first course 202, 212 are aligned such that the channel 78 for the blocks in the second course 204, 214 can be placed over both the left pin 76 of a first block and the right pin 76 of an adjacent block. Thus, the construction line for the second course 204, 214 is generally aligned, though staggered, with the construction line 30 for the first course 202, 212, providing a vertical arrangement. FIG. 7 shows an example of a multiple level convex retaining wall 290.

Figure 8:
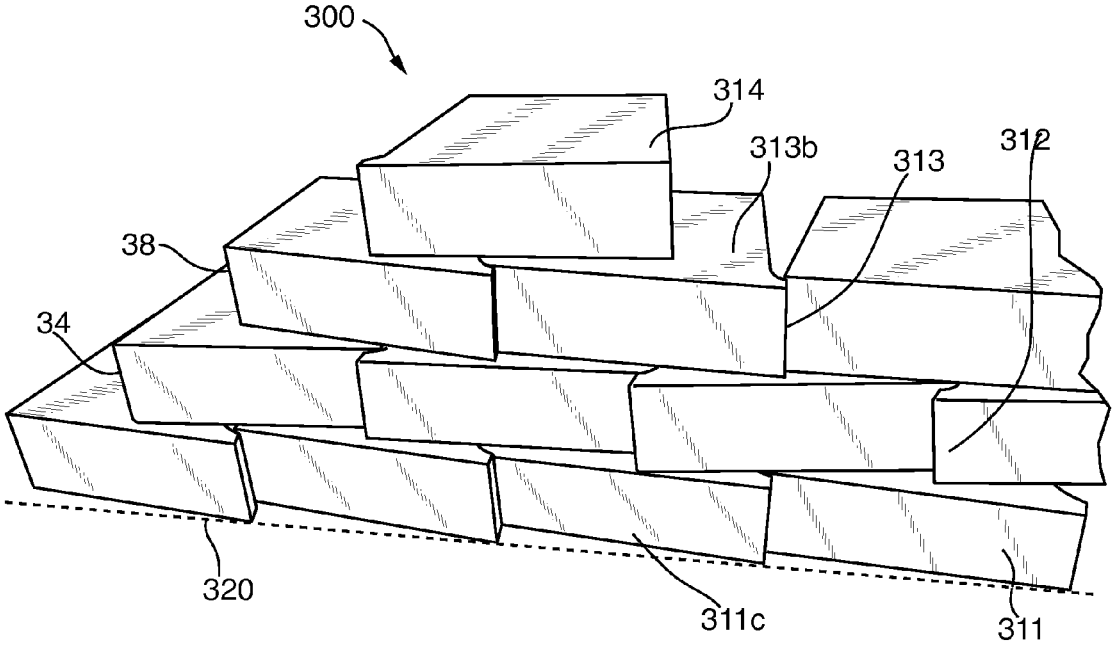
FIG. 8 is a top perspective view of a sixth partial wall system having slant wall blocks in periodically alternating orientations.

It will be appreciated that the "left" and "right" directions used in illustrative examples herein are can be reversed for blocks and/or orientations thereof. Further, such left and right directions can be reversed while defining the same horizontal alignment direction. For example, FIG. 8 shows another embodiment partial wall 300 using wall blocks 310 having four progressively higher courses 311, 312, 313, 314, wherein each course is alternately oriented in opposite directions. The blocks 310 can be, for instance, similar to block 10. In courses 311 and 313, the nose 34 of each block 310 is directed in one direction, and in courses 312 and 314 the nose of each block is directed in the opposite direction. Each respectively higher course 312, 313, 314 appears to be angling away from the underlying course, but in fact both courses are following the horizontal alignment direction of the base course 311, which is also represented by the edge 320. This produces a different and interesting aesthetic. For example, the block 311*c* (third block from the left) in the first course 311 has the same orientation as block 313*b* (the second block from the left) in the third course 313, except that block 313*b* is setback approximately 2 times (d3) relative to block 311*c*.

Figure 9:
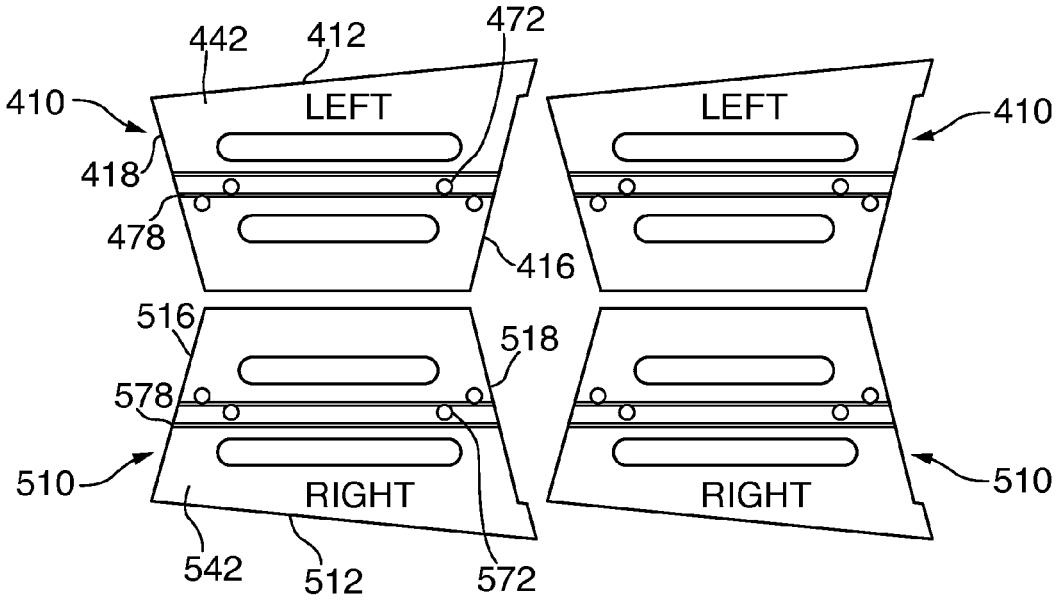
FIG. 9 is a bottom plan view of slant blocks in right hand and left hand orientation.

One way of providing the alternating courses as shown in FIG. 8 is to use left handed and right handed blocks for respective courses. FIG. 9 shows lower surfaces of upper and lower pairs of left hand oriented (left hand) blocks 410 and right hand oriented (right hand) blocks 510, respectively. The left hand and right hand blocks 410, 510 can be made, for instance, in pairs, or can be made separately. In the left hand blocks 410, similar to FIG. 1*b*, the front face 412 when looking down from the top of the block is slanted back from right to left, while in the right hand blocks 510, the front face 512 is slanted back from left to right. In both of the blocks 410, 510, the channels 478, 578 are aligned with the front pin cores 472, 572.

Figure 10:
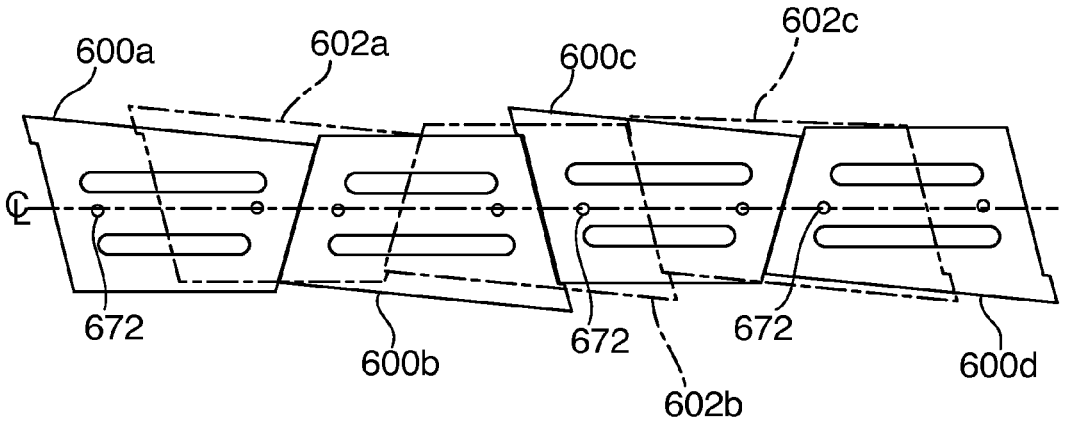
FIG. 10 is a top plan view of a seventh partial wall system in which adjacent blocks along each course are reversed in orientation.
Figure 11:
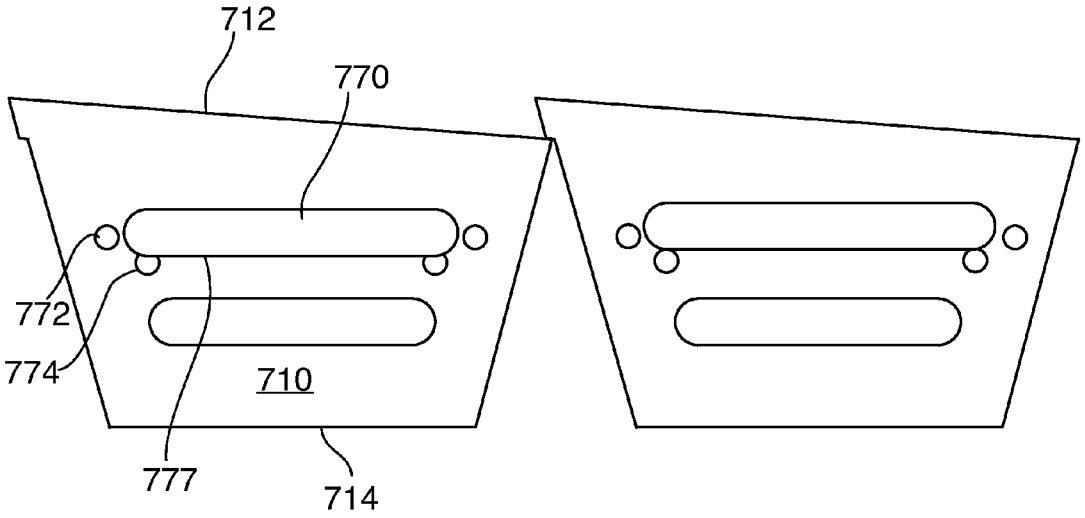
FIG. 11 is a top plan view of a fourth embodiment slant block.

Other example walls include blocks that alternate in orientation along the same course. FIG. 10 shows upper 600*a*, 600*b*, 600*c*, 600*d* and lower 602*a*, 602*b*, 602*c* courses (the lower course is shown in dashed lines) of alternating left handed blocks. Within each course 600, 602, adjacent blocks are reversed in orientation, providing front and back construction lines that are parallel to one another. Within each course, the front pin cores 672 (rear pin cores not shown) of each block are aligned.

FIGS. 11, 12*a*-12*b*, and 13*a*-13*b* show an alternative slant block 710 that allows pins to be used for alignment in either vertical or setback arrangement for both left hand and right hand orientation. Front pin cores 772 (full depth) are disposed laterally outside of a block alignment core 770 along a first line. Rear pin cores 774 (full depth) are disposed along a second line that is set back from the first line by a predetermined setback distance. The front pin cores 772 and the rear pin cores 774 are located with respect to the block alignment core 770 such that when pins 776 are inserted into the front pin cores 772 and a successive course of blocks are placed, the pins projecting from the lower course engage the rear wall 777 of the alignment cores 770 of the upper course to align the courses in a vertical alignment. Similarly, when pins 776 are inserted into pin cores 774 and successive courses are placed, the pins in the lower course engage the rear wall 777 of the upper course to thereby align the courses in a setback arrangement. Furthermore, the cooperation between the pin cores 772, 774, pins 776, and alignment core 770 functions to properly set the alignment of successive courses, whether the slant block is in a right hand or left hand orientation. This arrangement allows one to flip or invert the blocks 710 and still obtain connection without providing separate right and left handed blocks.

Figure 12A:
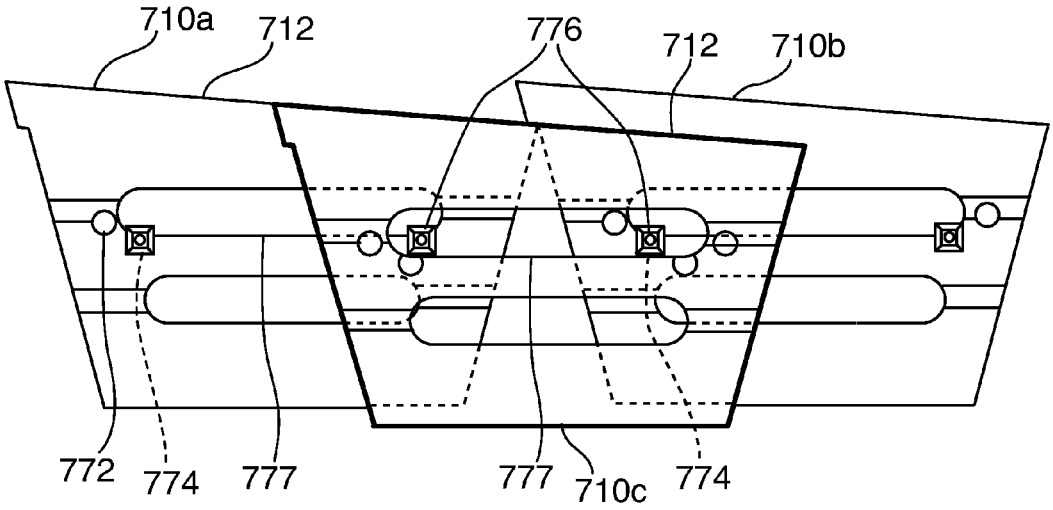
FIG. 12*a* is a top plan view of an eighth partial wall system including the slant block of FIG. 11, in a setback arrangement in which all blocks have the same orientation.

FIG. 12*a* shows two lower course blocks 710*a*, 710*b* and one upper course block 710*c* in a setback arrangement and running bond (half bond), where each of the blocks is in a left hand orientation. The front faces 712 of the blocks 710*c* and 710*a* are flush with one another, while the block 710*c* is set back by half the delta slant. Pins 776 are inserted into the rear pin cores 774 of the lower course blocks 710*a*, 710*b*. The upper course block 710*c* is placed over horizontally adjacent lower course blocks 710*a*, 710*b* such that a portion of the pins 776 is received by the rear wall 777 of the block alignment core 770 of the upper course block 710*c*.

Figure 12B:
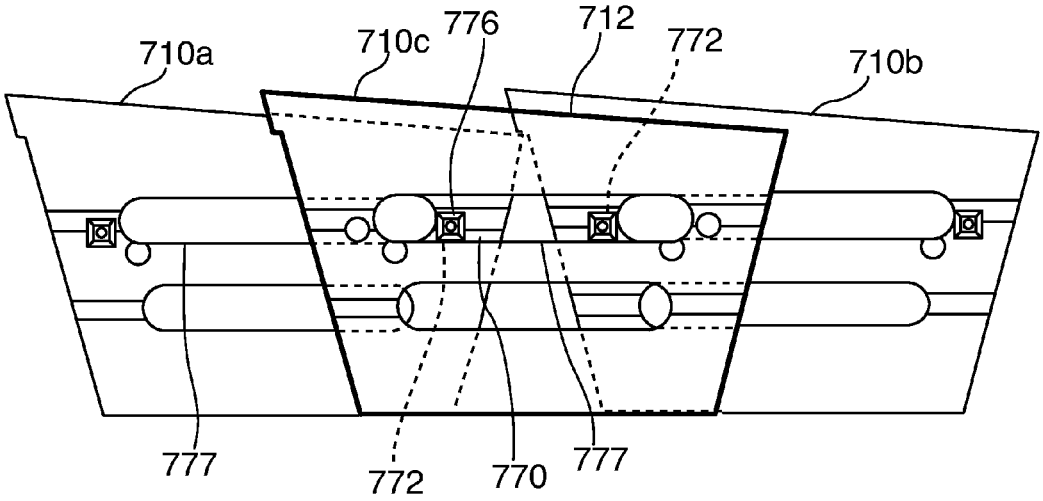
FIG. 12*b* is a top plan view of a ninth partial wall system including the slant block of FIG. 11, in a vertical arrangement in which all blocks have the same orientation.

FIG. 12*b* shows the two lower course blocks 710*a*, 710*b* and the upper course block 710*c* in a vertical arrangement and running bond (half bond), each of the blocks again being in a left hand orientation. The pins 776 are inserted into the front pin cores 772 of both the lower course blocks 710*a*, 710*b*. The upper course block 710*c* is placed over horizontally adjacent lower course blocks 710*a*, 710*b* such that a portion of the pins 776 is received by the rear wall 777 of the block alignment core 770 of the upper course block 710*c*.

Figure 13A:
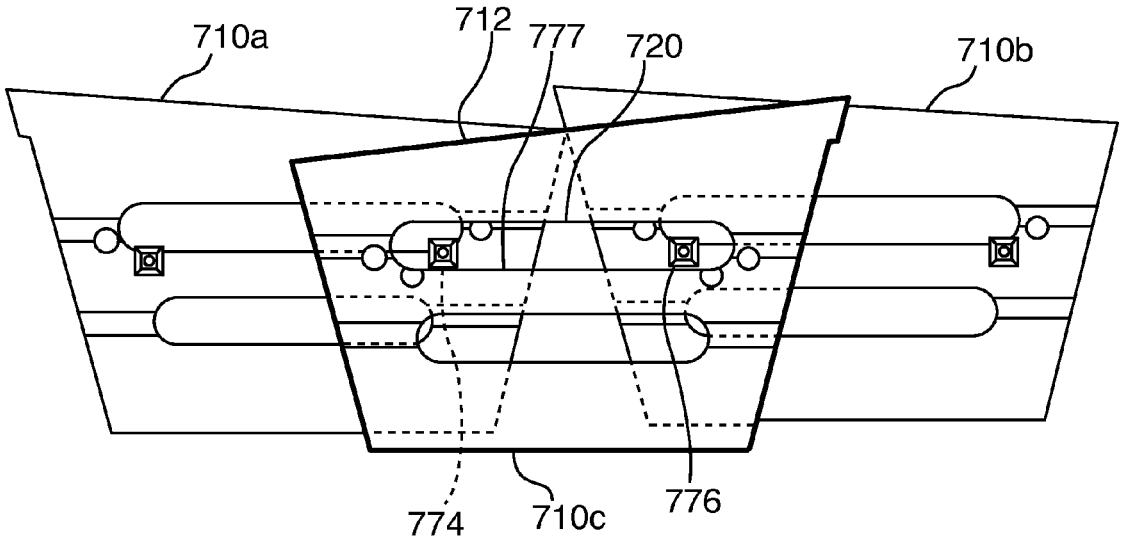
FIG. 13*a* is a top plan view of a tenth partial wall system including the slant block of FIG. 11, in a setback arrangement in which the second course blocks have a reversed orientation.

FIG. 13*a* shows the two lower course blocks 710*a*, 710*b* in a left hand orientation and the upper course block 710*c* in a right hand orientation. The blocks 710*a*, 710*b*, 710*c* are in a setback arrangement and running bond (half bond). Here, the pins 776 are inserted into the rear pin cores 774 of the blocks 710*a*, 710*b*. Again, the upper course block 710*c* is placed over horizontally adjacent lower course blocks 710*a*, 710*b* such that a portion of the pins 776 is received by the rear wall 777 of the block alignment core 770 of the upper course block 710*c*.

Figure 13B:
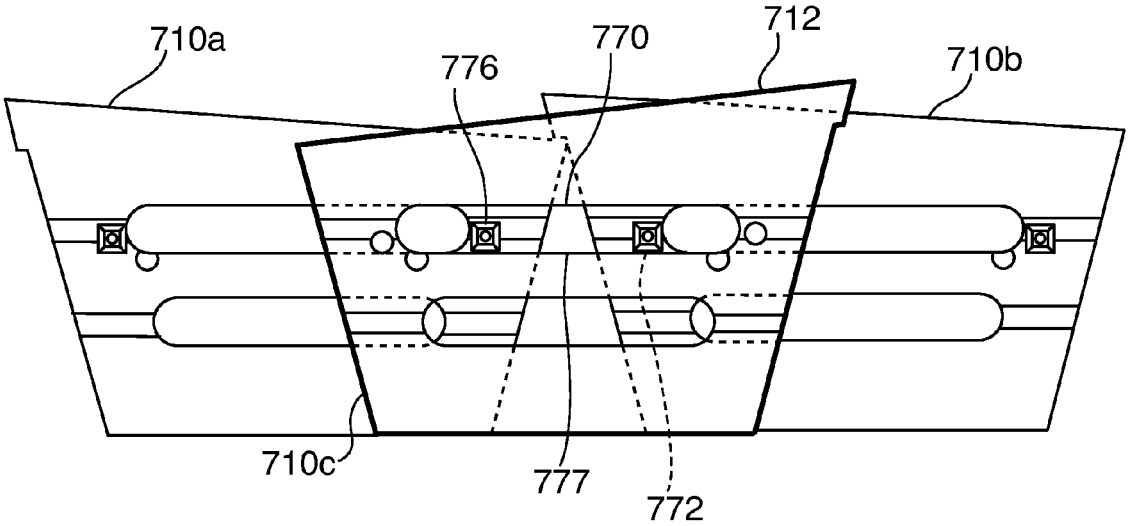
FIG. 13*b* is a top plan view of an eleventh partial wall system including the slant block of FIG. 11, in a vertical arrangement in which the second course blocks have a reversed orientation.

FIG. 13*b* again shows the two lower course blocks 710*a*, 710*b* in a left hand orientation and the upper course block 710*c* in a right hand orientation. The blocks 710*a*, 710*b*, 710*c* are in a vertical arrangement and running bond (half bond). The pins 776 are inserted into the front pin cores 772 of the blocks 710*a*, 710*b*. The upper course block 710*c* again is placed over horizontally adjacent lower course blocks 710*a*, 710*b* such that a portion of the pins 776 is received by the rear wall 777 of the block alignment core 770 of the upper course block 710*c*.

Figure 14:
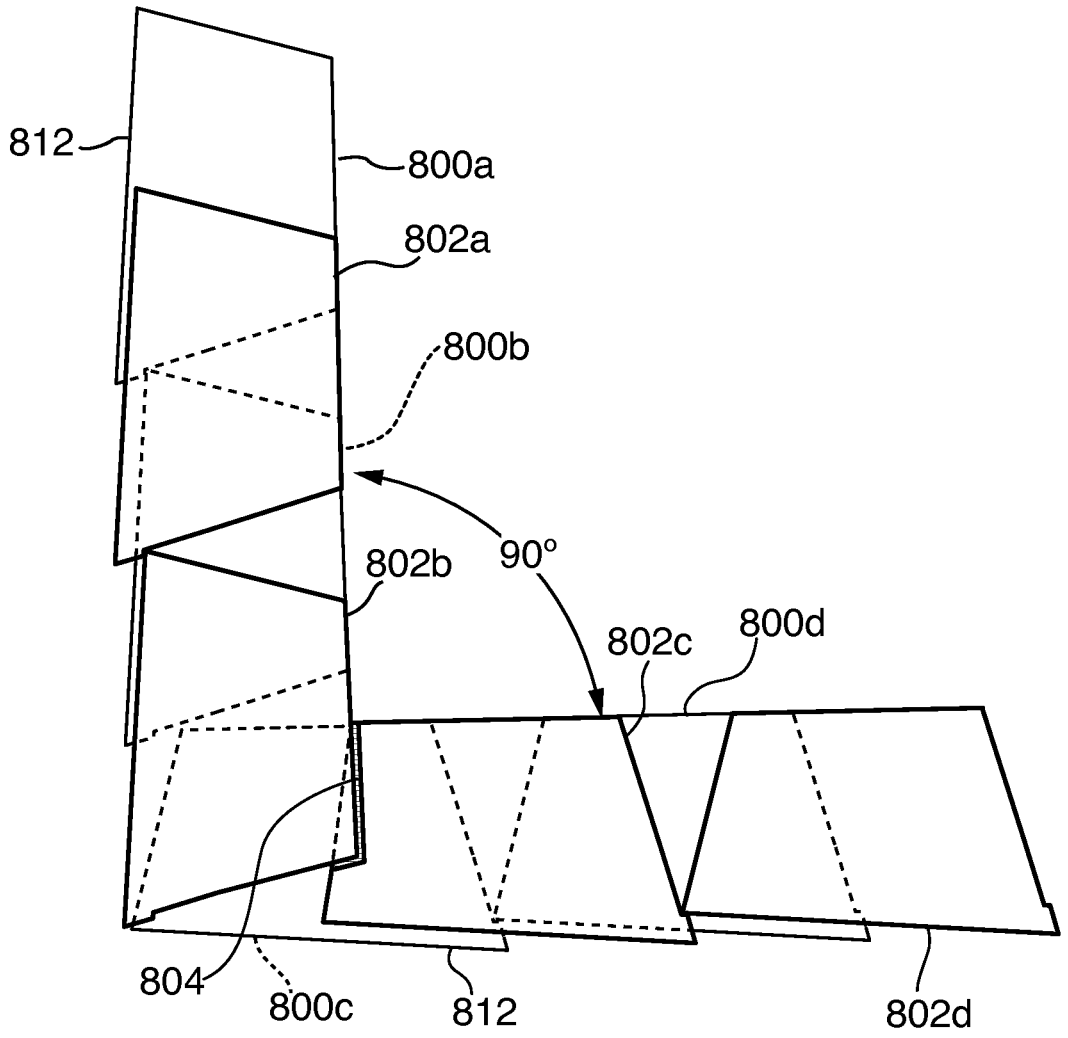
FIG. 14 is a top plan view of a twelfth partial wall system having an outside corner arrangement.
Figure 15:
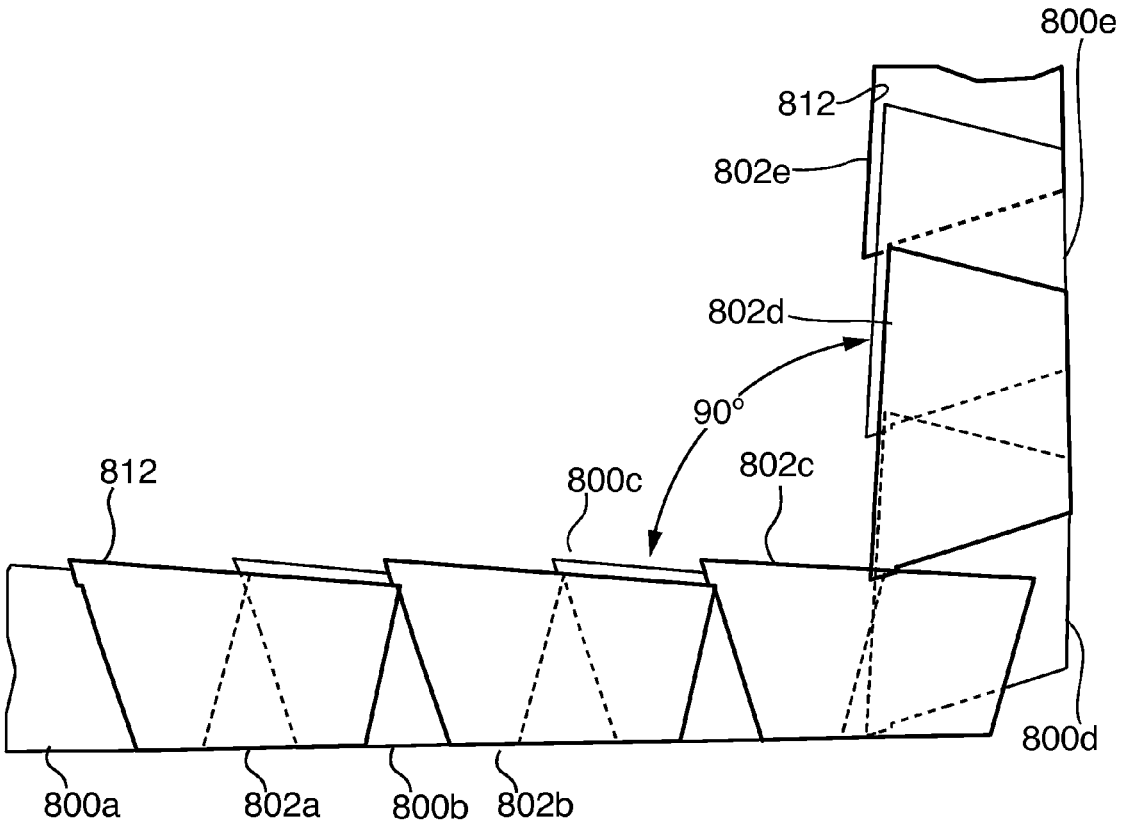
FIG. 15 is a top plan view of a thirteenth partial wall system having an inside corner arrangement.

Example slant blocks can provide corners for walls. FIG. 14 shows an outside cornered wall, and FIG. 15 shows an inside cornered wall, both in a vertical arrangement and half bond. Each leg of the wall includes lower course 800 and upper course 802 of blocks. In the outside corner of FIG. 14, a corner block, such as block 802*b*, has a portion 804 removed to join with the block 802*c* of the adjoining leg. In the inside corner shown in FIG. 15, each successive course is built in the vertical arrangement, such that the blocks on each side of the inside corner abut and slide against or extend beyond the adjoining unit. In example walls, by omitting cores and channels, the resulting solid blocks can serve as cap and corner units as well. Adhesive can be used, for example, to lock caps or corners to the wall without using pins.

Figure 16A:
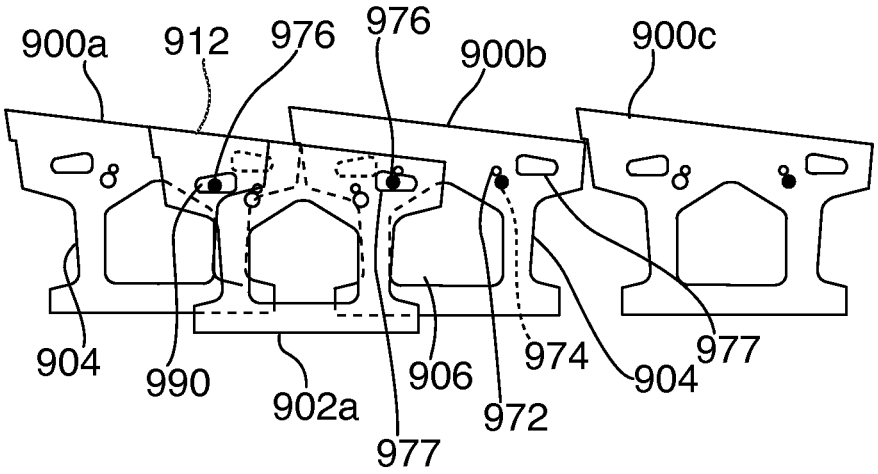
FIG. 16*a* is a top plan view of a fourteenth partial wall system including a fifth embodiment slant block.
Figure 16B:
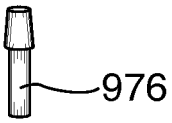
FIG. 16*b* is a shouldered pin for the partial wall system of FIG. 16*a*.
Figure 18A:
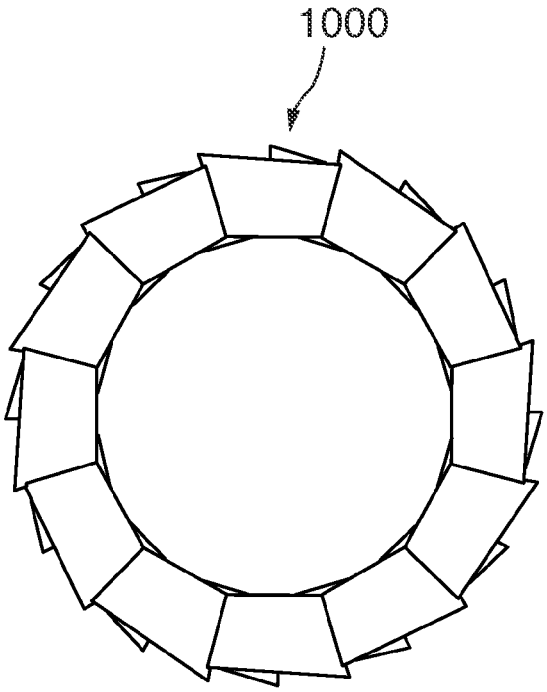
FIGS. 18*a*-18*c* are plan views of the columns of FIGS. 17*a*-17*c*, respectively.
Figure 18B:
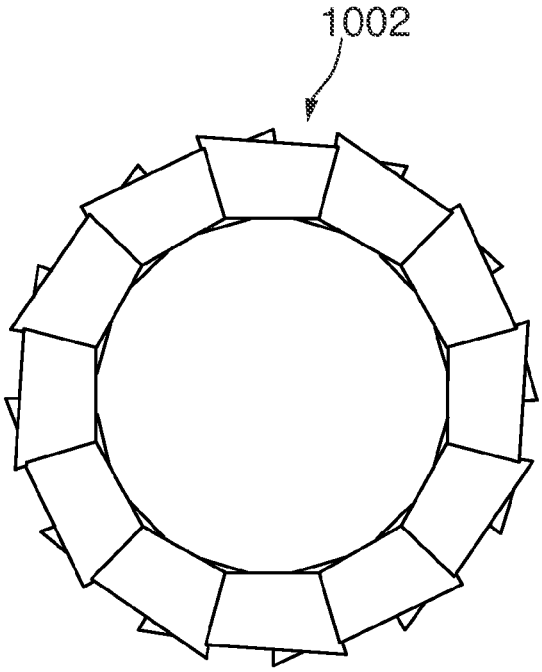

FIG. 16*a* shows lower course blocks 900*a*, 900*b*, 900*c* and an upper course block 902*a* for an alternative embodiment slant block. The slant block is configured similarly to the slant block 10, but with side and central cutouts 904, 906. Further, each block 900 includes a front set of pin cores 972, a rear set of pin cores 974, and a set of block alignment cores 990. A shoulder pin 976, best viewed in FIG. 16*b*, can be inserted into either the front pin cores 972 or the rear pin cores 974 of the lower course blocks 900*a*, 900*b*, 900*c*, for either vertical or setback arrangement (setback arrangement is shown in FIG. 16*a*). The upper course block 902*a* is placed over the horizontally adjacent lower course blocks 900*a*, 900*b* so that rear walls 977 of the block alignment cores 990 receive respective upper portions of the shoulder pin 976. The blocks 900*a*, 900*b*, 900*c*, 902*a* can be used in either right hand or left hand orientation by inverting the block as described with reference to the slant block 710 in FIGS. 12*a*-12*d*.

Figure 17A:
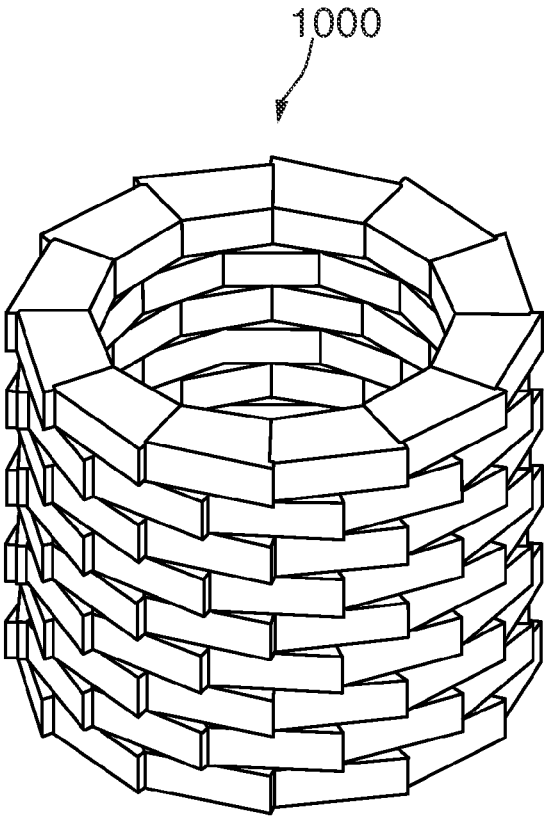
FIGS. 17*a*-17*c* are perspective views of columns in which slant blocks in successive courses are oriented in the same direction (FIG. 17*a*), in reverse directions (FIG. 17*b*), and in the same direction but with a quarter bond turn in each successive course (FIG. 17*c*).
Figure 17B:
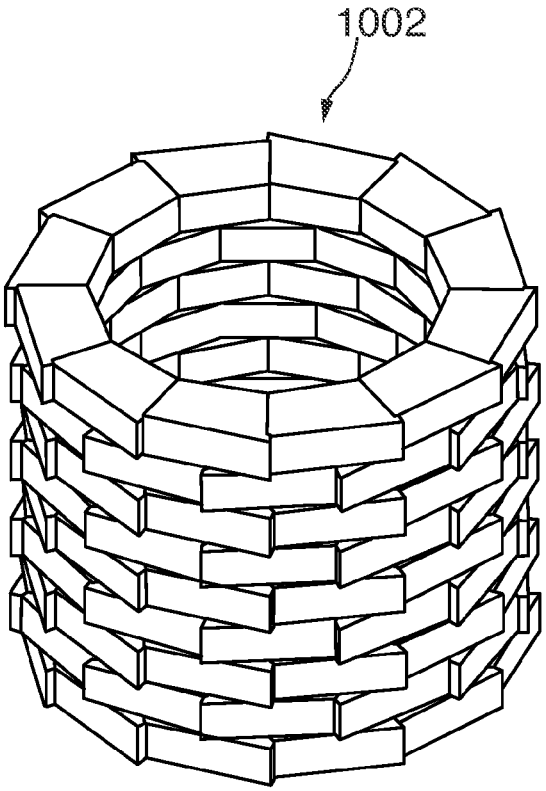
Figure 17C:
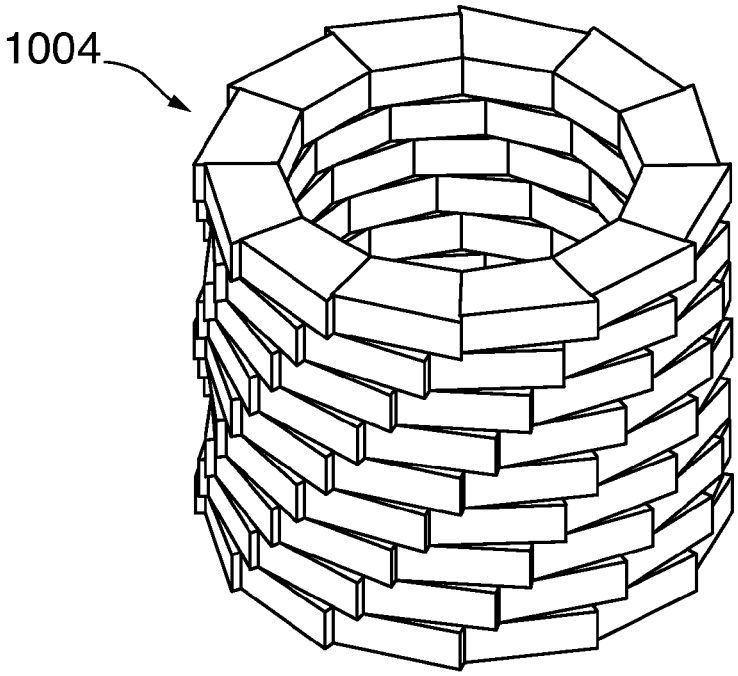
Figure 18C:
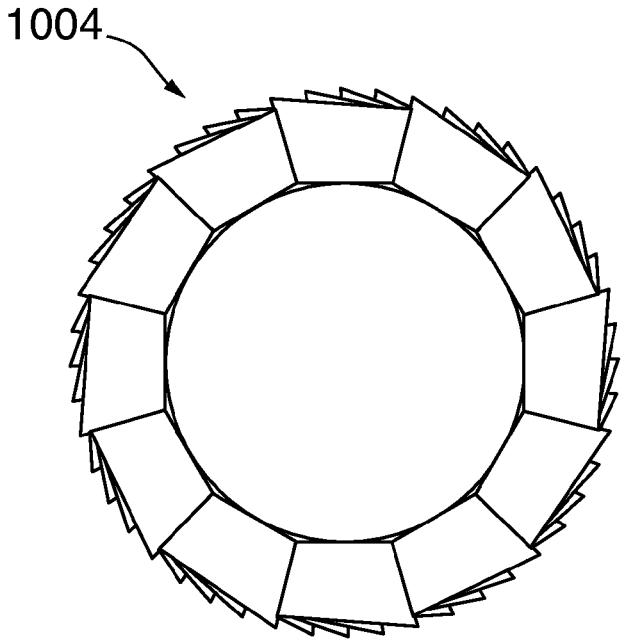

By laterally shifting slant blocks, for instance a quarter bond on each successive course, a spiral effect can be created for a wall. FIGS. 17*a*-17*b* and 18*a*-18*b* show blocks 1000, 1002 in running bond patterns in which, as the courses rise above a base level, the blocks align in a half bond pattern and are either oriented the same direction in every course (blocks 1000, see FIG. 17*a*, FIG. 18*a*) or are reversed in orientation on every other course (blocks 1002, see FIG. 17*b*, FIG. 18*b*). FIGS. 17*c* and 18*c* show blocks 1004 in a running bond as with blocks 1000, in which the blocks are arranged to advance by a quarter bond turn in each successive vertical course. This arrangement provides a "spiral" or rotating effect to the wall appearance.

Figure 19:
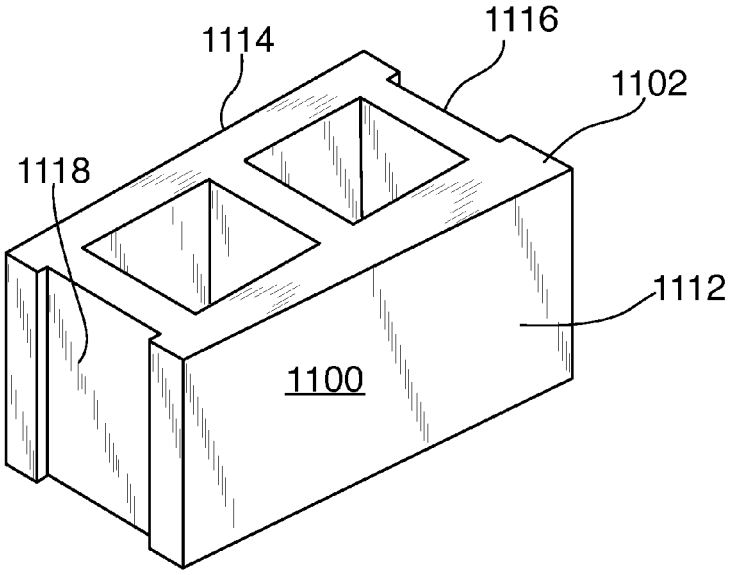
FIG. 19 is a perspective view of a concrete masonry unit having a slanted front face.
Figure 20:
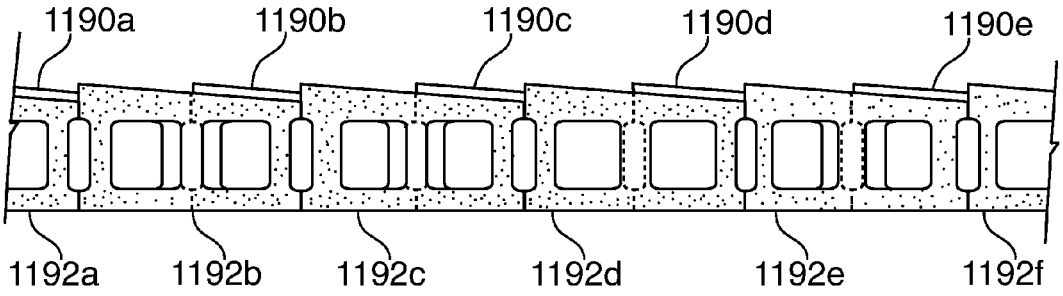
FIG. 20 is a plan view of a fifteenth partial wall system including the concrete masonry unit of FIG. 19.

The slant block may be manufactured in any manner of substantially any material. Dry cast concrete is preferred for exterior retaining wall applications. FIGS. 19 and 20 show a concrete masonry block 1100 in which a slant wedge 1102 extends from a front of the block to incorporate a slanted front face 1112 into the block. The left and right sides 1116, 1118 and the back face 1114 are generally orthogonal to one another. FIG. 20 shows lower course blocks 1190*a*, 1190*b*, 1190*c*, 1190*d*, 1190 *e* and upper course blocks 1192*a* 1192*b*, 1192*c*, 1192*d*, 1192*e*, 1192*f* in a partial structure having a half bond layout. The head and bed joints are mortared. Such blocks 1100 can be used to build internally reinforced and mortared structures.

FIG. 21 shows a structure 1200 having slant blocks arranged in a stack bond coursing. FIG. 22 shows a structure 1300 having both courses 1302 arranged in running or half bond, and panels 1304 of stack bond coursing. Alternatively or additionally, the courses 1302 and/or the panels 1304 can include reversed orientation coursing. It will be appreciated that many combinations of vertical and setback arrangements, same-orientation and reverse orientation coursing, stack bond or running bond arrangements, linear, convex, concave, corner, or spiral arrangements, etc. are possible.

Example slant blocks can be used in any of various wall sections and walls. Slant blocks uses include, but are not limited to, retaining walls, exterior and interior building blocks, wall tile, wall veneers, wall panels, and column blocks.

While preferred embodiments of the slant block wall and wall system have been herein illustrated and described, it is to be appreciated that certain changes, rearrangements and modifications may be made therein without departing from the scope of the invention as defined by the appended claims.

What is claimed is:

1. A wall block configured to be arranged with other like blocks to form a wall, the block comprising:

an upper surface and a lower surface, the lower surface being opposed to the upper surface;

a front face and an opposed back face disposed between the upper surface and the lower surface, the front face being substantially perpendicular to the upper surface and the lower surface;

a first side face and an opposed second side face disposed between the upper surface and the lower surface, wherein both the first side face and the second side face generally extend from the front face to the back face; and one or more features on the block defining a horizontal alignment direction, wherein the front face extends from the first side face to the second side face generally along a direction that is slanted with respect to the horizontal alignment direction to define a front-to-back slant distance along the front face between the first side face and the second side face;

wherein the one or more features comprises a first set of horizontally spaced pin cores disposed along a first line and a second set of horizontally spaced pin cores disposed along a second line that is parallel to and set back from the first line by a predetermined setback distance that is substantially one-half of the front-to-back slant distance;

wherein said horizontal alignment direction is parallel to the first line and the second line;

wherein the front face at a midpoint between the first side face and the second side face is set back from the front face at the first side face by a distance substantially equal to the predetermined setback distance;

whereby, when a like block is disposed over the block in a half bond arrangement such that the like block is disposed over the second side face of the block, and when the like block is set back from the block by the predetermined setback distance, the front face of the like block is substantially coplanar with the front face of the block.

2. The wall block of claim 1, wherein the one or more features further includes a lip extending downwardly from the bottom face of the block;

wherein a front surface of the lip is separated from the back face by the predetermined setback distance in a front-to-back direction of the block.

3. The wall block of claim 1, wherein the first side and the second side are oriented at side angles with respect to the horizontal alignment direction, and wherein each of the side angles are between 5 and 20 degrees.

4. The wall block of claim 1, further comprising:

at least one block alignment core having a portion disposed along one or more of the first line or the second line.

5. The wall block of claim 1, further comprising a side cutout disposed at each of the first side face and the second side face, the side cutouts extending from the upper surface to the lower surface.

6. The wall block of claim 1, further comprising a central cutout disposed between the first side face, the second side face, the front face, and the back face.

7. The wall block of claim 1, further comprising:

a side cutout disposed at each of the first side face and the second side face;

a central cutout disposed between the first side face, the second side face, the front face, and the back face; and a set of block alignment cores extending through the lower surface and the upper surface.

8. The wall block of claim 7, wherein each of the set of block alignment cores has a portion disposed along the first line.

9. The wall block of claim 1, wherein the front face is textured.

10. The wall block of claim 1, wherein each of the first set and the second set of pin cores consists of two pin cores.

11. A wall block configured to be arranged with other like blocks to form a wall, the block comprising:

an upper surface and a lower surface, the lower surface being opposed to the upper surface;

a front face and an opposed back face disposed between the upper surface and the lower surface, the front face being substantially perpendicular to the upper surface and the lower surface;

a first side face and an opposed second side face disposed between the upper surface and the lower surface, wherein both the first side face and the second side face generally extend from the front face to the back face; and one or more features on the block defining a horizontal alignment direction, wherein the front face extends from the first side face to the second side face generally along a direction that is slanted with respect to the horizontal alignment direction to define a front-to-back slant distance along the front face between the first side face and the second side face;

wherein the back face extends from the first side face to the second side face generally along a direction that is parallel to the horizontal alignment direction;

wherein the front face at a midpoint between the first side face and the second side face is set back from the front face at the first side face by substantially one-half of the front-to-back slant distance;

wherein the front face is textured.

12. A course of blocks comprising:

a plurality of blocks arranged side to side along a line to form at least one course, each block comprising:

an upper surface and a lower surface, the lower surface being opposed to the upper surface;

a front face and an opposed back face disposed between the upper surface and the lower surface, the front face being substantially perpendicular to the upper surface and the lower surface;

a first side face and an opposed second side face disposed between the upper surface and the lower surface, wherein the front faces of each of the blocks in the course generally extend along a continuous direction that is slanted relative to said line to define a front-to-back slant distance along the front face between the first side face and the second side face, to form a generally jagged or sawtoothed shape;

wherein the front face at a midpoint between the first side face and the second side face is set back from the front face at the first side face by a predetermined setback distance that is substantially one-half of the front-to-back slant distance;

whereby, when a like block is disposed over two of the blocks in the course and arranged between the two of the blocks in a half bond arrangement, and the like block is set back from the course by the predetermined setback distance, the front face of the like block is substantially coplanar with the front face of one of the two blocks in the course.

13. A course of blocks as in claim 12, wherein each block further comprises a projection disposed at the front face adjacent the first side, a mating surface disposed adjacent the projection and a mating edge at the intersection of the front face and the second side;

wherein the blocks are arranged such that the mating edge of each successive block in the course is placed to be captured or engaged with the mating surface of an adjacent block.

14. A course of blocks as in claim 12, wherein at least one block is reversed in orientation with respect to an adjacent block along the course.

15. A wall section including plural courses of claim 12, wherein the blocks are arranged to further provide at least a second said course on top of the first course;

wherein blocks in the second course are staggered from left to right with respect to the blocks in the first course;

wherein the blocks in the second course are in a line parallel to the line of the first course.

16. The wall section of claim 15, wherein the line of the second course is vertically aligned with the line of the first course so that the wall is substantially vertical.

17. The wall section of claim 15, wherein the line of the second course is set back relative to the line of the first course by the predetermined setback distance.

18. The wall section of claim 17, wherein blocks in the second course are staggered from left to right with respect to blocks in the first course in a half bond arrangement, such that at least one block in the second course is disposed over and between two adjacent blocks in the first course;

wherein the predetermined setback distance is substantially one half of the front-to back slant distance of the front face of each block relative to the line;

wherein the front face of the at least one block in the second course is substantially coplanar with the front face of one of the two adjacent blocks in the first course.

19. The wall section of claim 15, wherein the front faces of the blocks in the second course are slanted in a direction opposite to the slant of the front faces of the blocks in the first course.

20. The wall section of claim 15, wherein the blocks of the second course are in at least one of a running bond, quarter bond, half bond, and three-quarter bond arrangement.

21. The wall section of claim 15, wherein the blocks of the second course are laterally shifted with respect to the first course to create a spiral effect for the wall section.

22. The wall section of claim 12, wherein the blocks are arranged to further provide at least a second said course on top of the first course;

wherein blocks in the second course are vertically stacked with respect to the blocks in the first course to provide a stack bond arrangement;

wherein the blocks in the second course are in a line parallel to the line of the first course.

* * * * *